US008002023B2

(12) United States Patent
Murayama

(10) Patent No.: US 8,002,023 B2
(45) Date of Patent: Aug. 23, 2011

(54) HEAT EXCHANGER AND ITS MANUFACTURING METHOD

(75) Inventor: Takuya Murayama, Aichi (JP)

(73) Assignee: Panasonic Corporation, Osaka (JP)

( * ) Notice: Subject to any disclaimer, the term of this patent is extended or adjusted under 35 U.S.C. 154(b) by 190 days.

(21) Appl. No.: 12/281,396

(22) PCT Filed: Mar. 16, 2007

(86) PCT No.: PCT/JP2007/055365

§ 371 (c)(1),
(2), (4) Date: Sep. 2, 2008

(87) PCT Pub. No.: WO2007/119394

PCT Pub. Date: Oct. 25, 2007

(65) Prior Publication Data

US 2009/0032232 A1 Feb. 5, 2009

(30) Foreign Application Priority Data

Mar. 22, 2006 (JP) ..... 2006-078431
Mar. 22, 2006 (JP) ..... 2006-078432
Mar. 22, 2006 (JP) ..... 2006-078433

(51) Int. Cl.
*F28F 3/08* (2006.01)
*F28F 3/00* (2006.01)
*F28F 7/00* (2006.01)
*B21D 53/02* (2006.01)

(52) U.S. Cl. ..... 165/167; 165/166; 165/78; 29/890.03

(58) Field of Classification Search ..... 165/166–167, 165/78, 906; 29/890.03
See application file for complete search history.

(56) References Cited

U.S. PATENT DOCUMENTS 2,846,197 A * 8/1958 Berg et al. ..... 165/166
2,961,222 A * 11/1960 Butt ..... 165/166
4,898,233 A * 2/1990 Grehier et al. ..... 165/166
5,992,510 A * 11/1999 Kallrot ..... 165/78
2006/0196649 A1 * 9/2006 Shibata et al. ..... 165/166

FOREIGN PATENT DOCUMENTS

JP 58-107488 7/1983
JP 61-179712 A 8/1986
JP 08-042988 A 2/1996
JP 08-110076 A 4/1996

(Continued)

OTHER PUBLICATIONS

International Search Report for Application No. PCT/JP2007/055365 dated May 29, 2007.

*Primary Examiner* — Ljiljana (Lil) V Ciric
(74) *Attorney, Agent, or Firm* — RatnerPrestia

(57) ABSTRACT

A heat exchanger for exchanging heat through a heat transfer plate by flowing a primary air current and a secondary air current to a ventilation path. An unit element including the heat transfer plate, and the ventilation path formed between the heat transfer plates by stacking the unit element in plural are arranged. The unit element is configured by integrally molding a spacing rib for holding a spacing of the heat transfer plate, and a shield rib for shielding leakage of the air current with resin. Furthermore, the unit element includes a stacking error detecting unit for determining a stacking error when stacked.

31 Claims, 20 Drawing Sheets

FOREIGN PATENT DOCUMENTS

| | | | |
|---|---|---|---|
| JP | 09-184693 | A | 7/1997 |
| JP | 10-170176 | | 6/1998 |
| JP | 3023546 | B2 | 1/2000 |
| JP | 2000-271976 | A | 10/2000 |
| JP | 2000-351135 | A | 12/2000 |
| JP | 2001-232663 | A | 8/2001 |
| JP | 2004-330728 | A | 11/2004 |
| JP | 2006-078431 | | 3/2011 |

* cited by examiner

HEAT EXCHANGER AND ITS MANUFACTURING METHOD

THIS APPLICATION IS A U.S. NATIONAL PHASE APPLICATION OF PCT INTERNATIONAL APPLICATION PCT/JP2007/055365.

TECHNICAL FIELD

The present invention relates to a heat exchanger of a laminated structure used in a home heat exchange ventilation fan, a total heat exchange ventilator in a building etc., and its manufacturing method.

BACKGROUND ART

This type of heat exchanger conventionally includes a heat exchanger formed by stacking a heat transfer plate and a spacer without bonding in order to suppress the manufacturing cost while enhancing the basic function such as ventilation resistance and heat conversion efficiency. This is disclosed in patent document 1 and the like. The heat exchanger will be described below with reference to FIG. 20A, FIG. 20B, and FIG. 21.

As shown in such figures, spacer 101 made of synthetic resin includes spacing rib 103 for holding a spacing between heat transfer plates 102, coupling rib 104 for coupling spacing ribs 103, and small projection 105 arranged on spacing rib 103 and coupling rib 104. The opposing surfaces of the spacer stacked one above the other include convex part 106 and concave par 107 that fit to each other and are integrally molded. Heat transfer plate 102 having heat transfer property and moisture permeability, or having only heat transfer property includes alignment hole 108. Alignment hole 108 fits with small projection 105 when spacer 101 and heat transfer plate 102 are stacked.

Heat exchanger 109 is obtained by stacking spacer 101 while alternately shifting by 90 degrees, and interposing heat transfer plate 102 between spacers 101. Heat exchanger 109 couples and holds spacers 101 by fitting convex part 106 and concave part 107 arranged at four corners of spacer 101.

When primary air current A and second air current B are flowed in the above-described configuration, heat is exchanged between primary air current A and secondary air current B through heat transfer plate 102.

Since such conventional heat exchanger 109 is obtained by stacking spacer 101 and heat transfer plate 102 without joining the same, a problem arises in that leakage of air current increases due to lowering in sealing property caused by the shift in stacking, and thus prevention of the leakage of air current due to lowering in sealing property caused by the shift in stacking is demanded.

Since heat exchanger 109 is formed by separately using two components of spacer 101 made of synthetic resin and heat transfer plate 102, the number of components becomes large, the processing step increases, and the manufacturing cost becomes high, and thus reduction of the manufacturing cost by reducing the number of components and reducing the processing steps is demanded.

Furthermore, heat exchanger 109 has a configuration of coupling and holding spacers 101 by fitting convex part 106 and concave part 107 arranged at four corners of spacer 101, but a problem arises in the step of stacking spacers 101 while alternately shifting by 90 degrees. If spacer 101 is stacked in the same direction, spacer 101 is coupled and held even in the incorrect stacking direction as convex part 106 and concave part 107 of spacer 101 are provided for the purpose of coupling and holding. In this case, heat exchanger 109 has a ventilation path formed in the same direction for every heat transfer plate 102, where heat cannot be exchanged at the incorrectly stacked portion when primary air current A and secondary air current B are flowed to heat exchanger 109. Thus, due to incorrect stacking of spacers 101, a problem arises in that heat conversion efficiency lowers due to the matter that the ventilation path cannot be correctly formed for every heat transfer plate 102. Therefore prevention of the lowering of heat conversion efficiency caused by the matter that the ventilation path cannot be correctly formed is demanded.

Moreover, since heat exchanger 109 alternately stacks spacer 101 in the same direction and couples and holds the same even in the incorrect stacking direction, production failure such as incorrect stacking occurs and mass productivity lowers, and thus enhancement of mass productivity by eliminating incorrect stacking of unit elements is demanded.

[Patent document 1] Japanese Patent No. 3,023,546

DISCLOSURE OF THE INVENTION

The present invention relates to a heat exchanger for exchanging heat through a heat transfer plate by flowing a primary air current and a secondary air current to a ventilation path, the heat exchanger having the following configuration. An unit element including the heat transfer plate, and the ventilation path formed between the heat transfer plates by stacking the unit element in plural are arranged, wherein the unit element is configured by integrally molding a spacing rib for holding a spacing of the heat transfer plate, and a shield rib for shielding leakage of the air current with resin. The unit element also includes a stacking error detecting unit for determining a stacking error when they are stacked.

The present invention relates to the following manufacturing method of manufacturing the heat exchanger. The method includes first step of obtaining the heat transfer plate by cutting a heat transfer plate material to a predetermined shape; and second step of obtaining an unit element by integrally molding the heat transfer plate, a spacing rib for holding a spacing of the heat transfer plate, and a shield rib for shielding leakage of the air current with resin. The method also includes third step of sequentially stacking the unit element rotated by 90 degrees in parallel to a heat transfer surface of the heat transfer plate with respect to an adjacent unit element; and fourth step of uniting the stacked unit elements. The unit element includes a stacking error detecting unit for determining a stacking error when they are stacked.

According to the heat exchanger and its manufacturing method of the present invention, enhancing mass productivity and preventing leakage of air current by eliminating incorrect stacking of the unit elements, and reducing manufacturing cost by reducing the number of components and reducing the number of processing steps are achieved.

DESCRIPTION OF SYMBOLS

Figure 1:
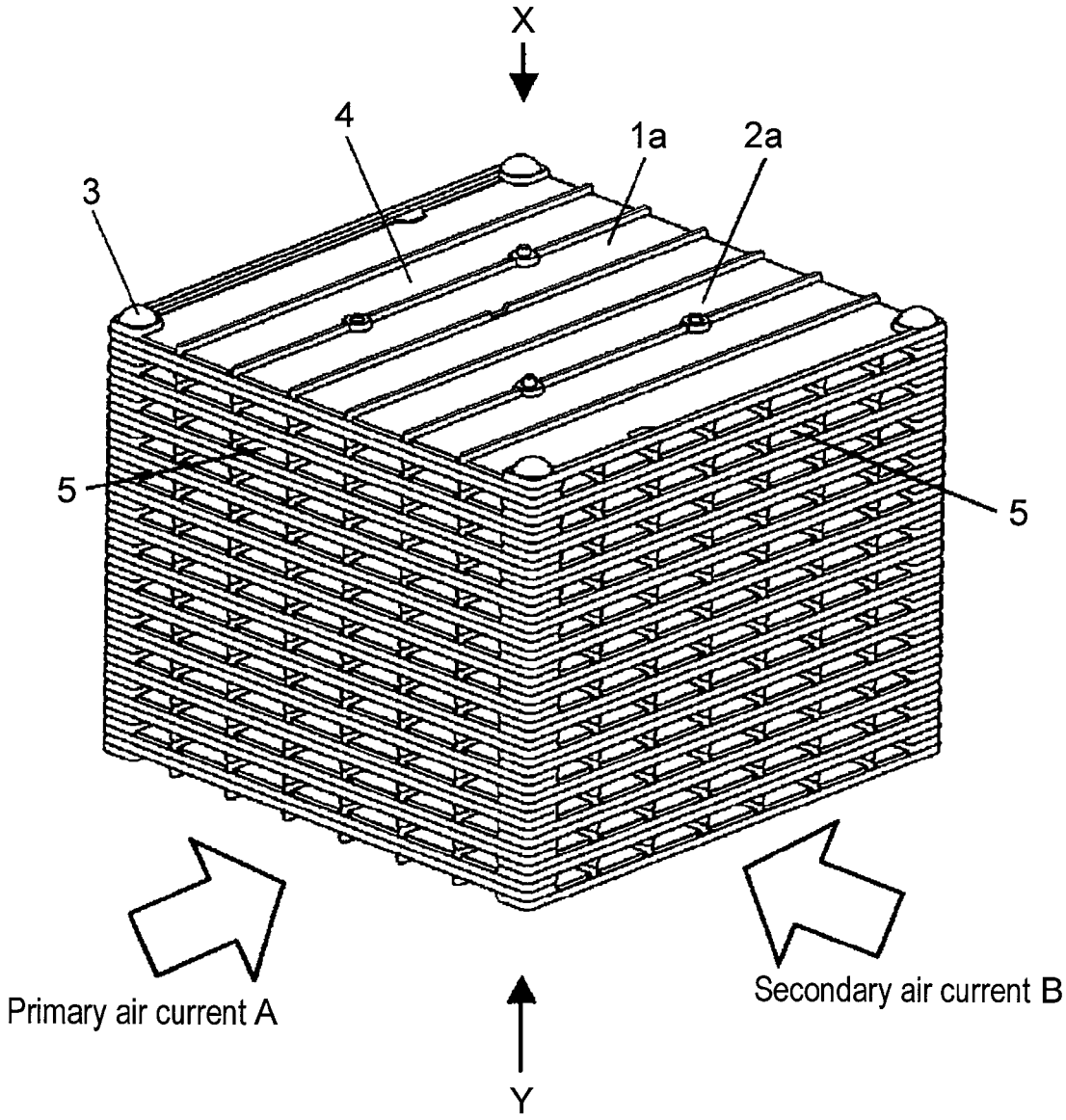
FIG. 1 is a schematic perspective view of a heat exchanger according to the first embodiment.

1*a*, 1*b* heat exchanger
2*a*, 2*b* unit element
3 supporting rod
4 heat transfer plate
5 ventilation path
6*a* first spacing rib
6*aa* second spacing rib
7*a* first shield rib
7*aa* second shield rib
8 shield rib concave part
9 rib pass-through hole
9*a* heat transfer plate pass-through hole
10 pass-through hole convex part
11 stacking check convex part
12 positioning convex part
13*a*, 13*aa* positioning pass-through hole
14*a*, 14*b* shield rib injection port
15 spacing rib injection port
16 shield rib convex part
17 pass-through hole concave part
19 positioning plane part
20*a*, 20*b*, 20*c*, 20*d*, 20*e*, 20*f* stacking escape part
21 positioning hole
22 first step (cutting)
23 second step (molding)
24 injection mold
25 heater
26 spool runner
27 third step (stacking)
28 fourth step (uniting)
29 spacing rib convex part
30 pass-through hole partial convex part
31 spacing rib concave part
32 pass-through hole partial concave part

PREFERRED EMBODIMENTS FOR CARRYING OUT OF THE INVENTION

Embodiments of the present invention will be hereinafter described using the drawings.

First Embodiment

Figure 2A:
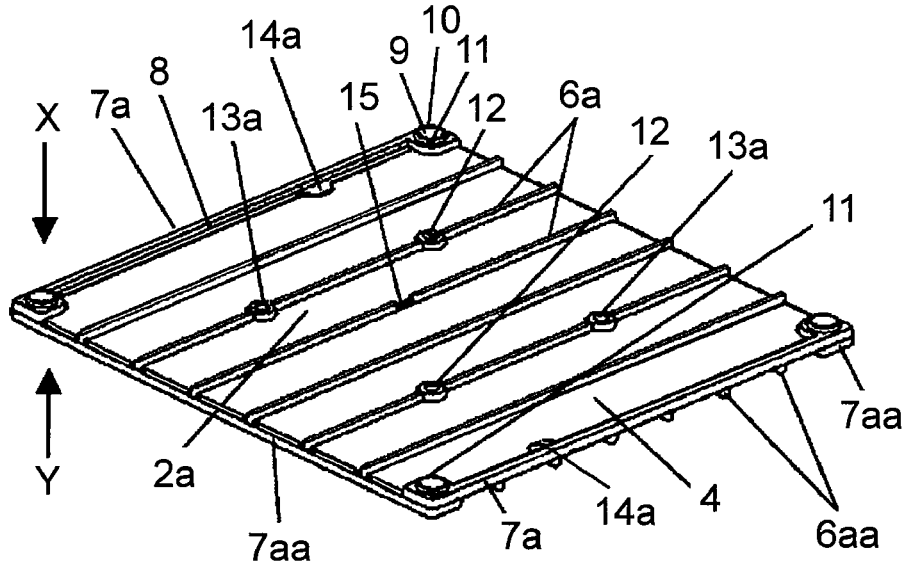
FIG. 2A is a schematic perspective view of a unit element seen from an X-direction shown in FIG. 1.
Figure 2B:
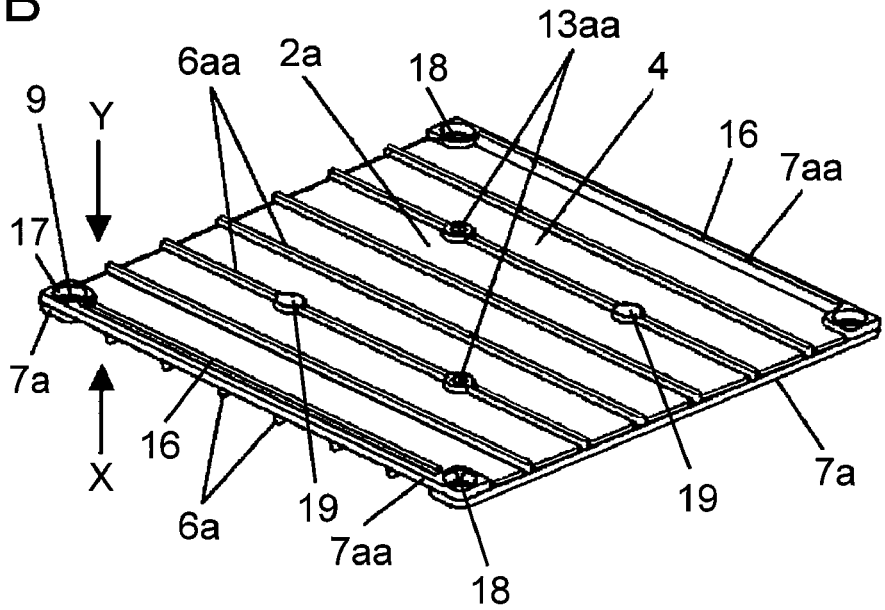
FIG. 2B is a schematic perspective view of the unit element seen from a Y-direction shown in FIG. 1.
Figure 3:
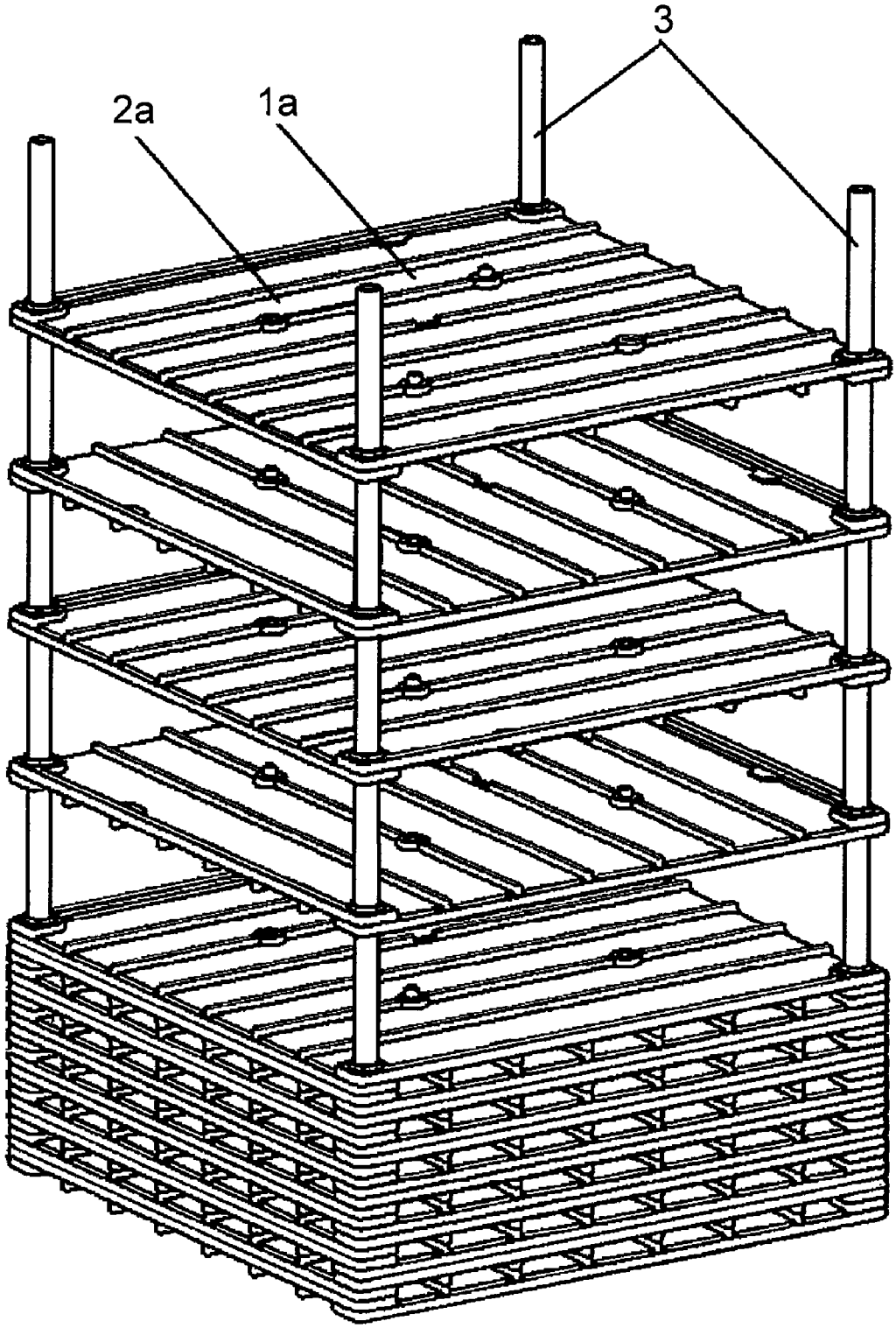
FIG. 3 is a schematic exploded perspective view of the heat exchanger shown in FIG. 1.
Figure 4A:
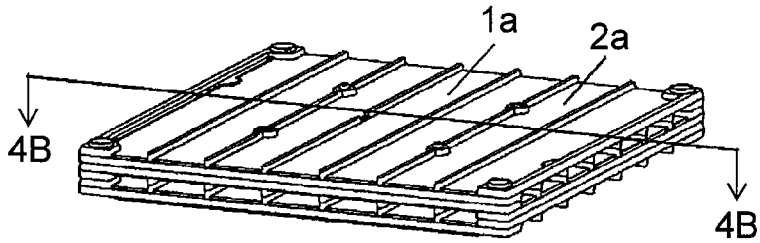
FIG. 4A is a schematic perspective view of the heat exchanger in which the unit elements of the heat exchanger shown in FIG. 1 are correctly stacked.
Figure 4B:
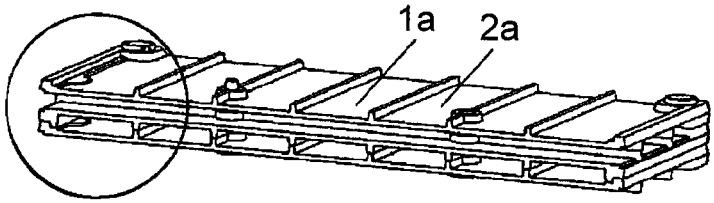
FIG. 4B is a schematic perspective view of the heat exchanger taken along line 4B-4B shown in FIG. 4A.
Figure 4C:
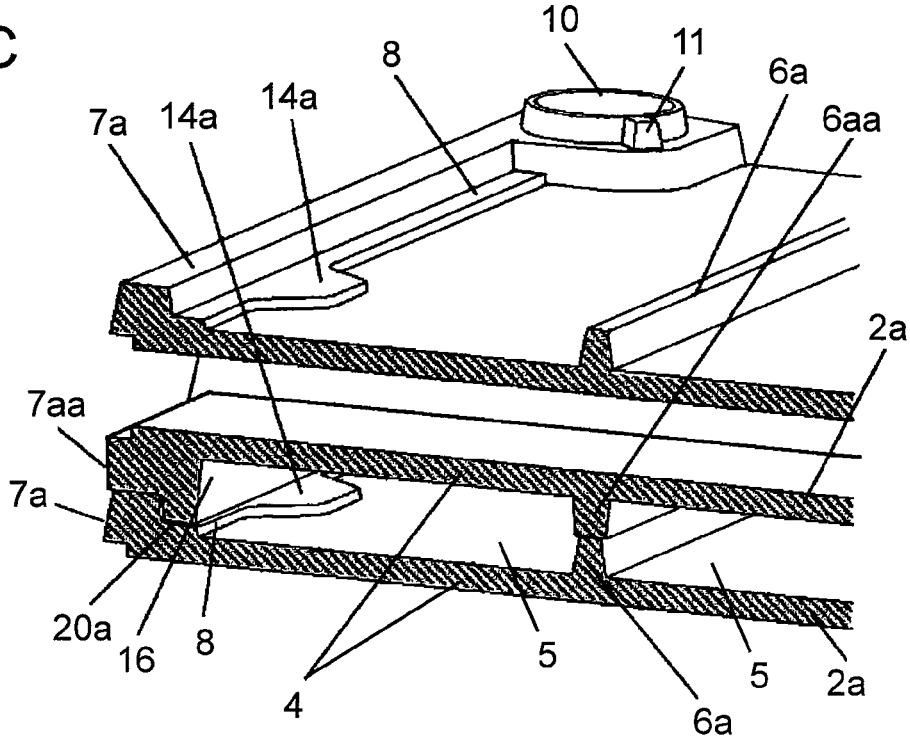
FIG. 4C is a schematic enlarged perspective view of a circled portion in FIG. 4B.
Figure 5A:
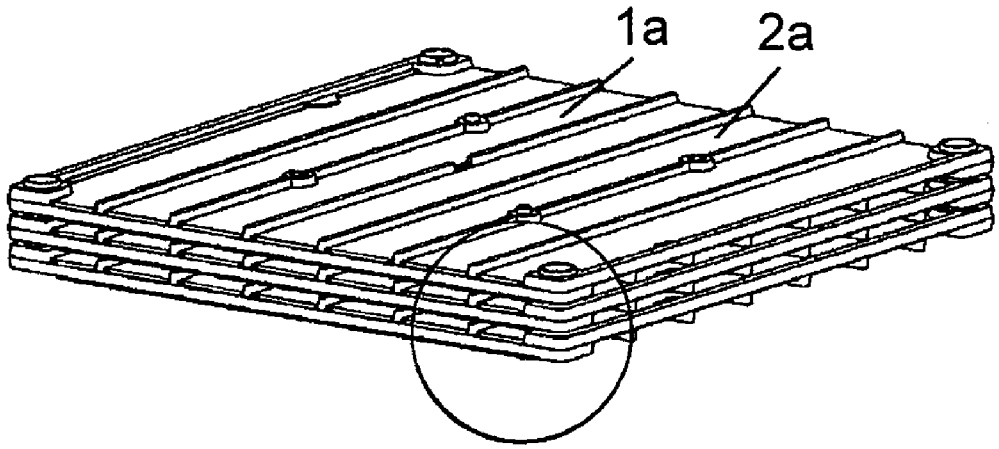
FIG. 5A is a schematic perspective view of the heat exchanger in which the unit elements of the heat exchanger shown in FIG. 1 are incorrectly stacked.
Figure 5B:
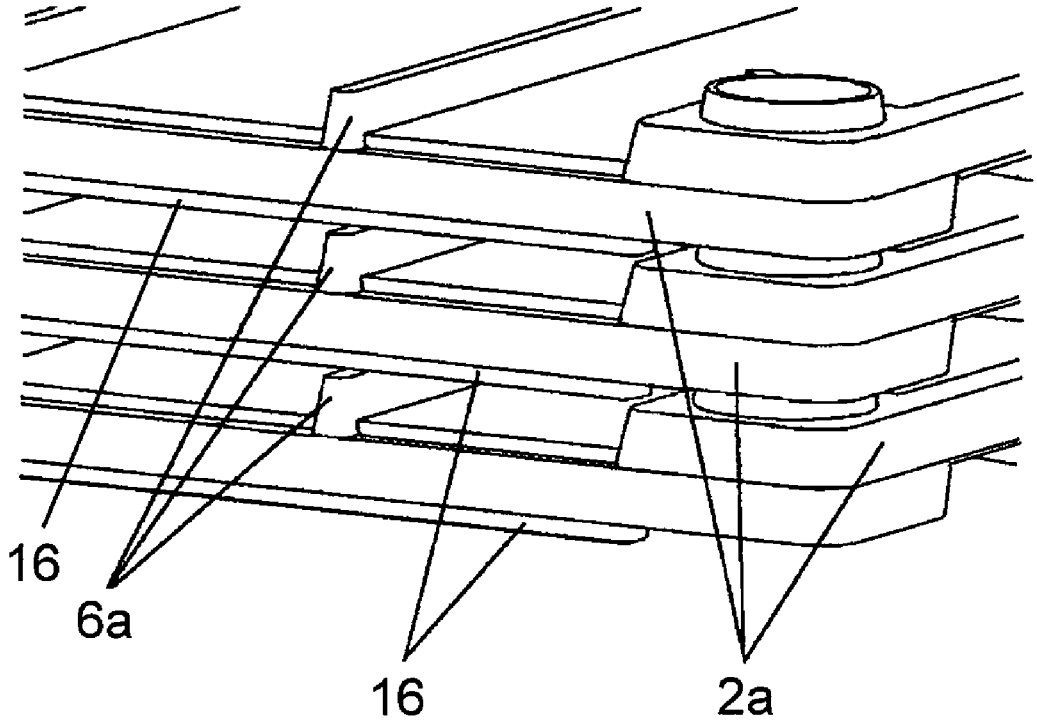
FIG. 5B is a schematic enlarged perspective view of a circled portion in FIG. 5A.

FIG. 1 is a schematic perspective view of a heat exchanger according to the first embodiment, FIG. 2A is a schematic perspective view of a unit element seen from an X-direction shown in FIG. 1, and FIG. 2B is a schematic perspective view of the unit element seen from a Y-direction shown in FIG. 1. FIG. 3 is a schematic exploded perspective view of the heat exchanger shown in FIG. 1. FIG. 4A is a schematic perspective view of the heat exchanger in which the unit elements of the heat exchanger shown in FIG. 1 are correctly stacked, FIG. 4B is a schematic perspective view of the heat exchanger taken along line 4B-4B shown in FIG. 4A, and FIG. 4C is a schematic enlarged perspective view of a circled portion in FIG. 4B. FIG. 5A is a schematic perspective view of the heat exchanger in which the unit elements of the heat exchanger shown in FIG. 1 are incorrectly stacked, and FIG. 5B is a schematic enlarged perspective view of a circled portion in FIG. 5A.

Figure 6A:
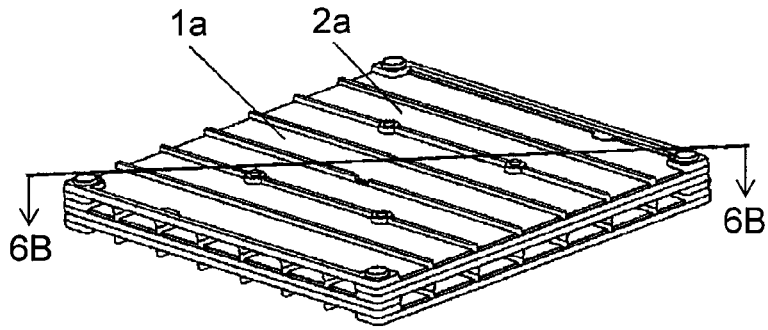
FIG. 6A is a schematic perspective view of the heat exchanger in which the unit elements of the heat exchanger shown in FIG. 1 are correctly stacked.
Figure 6B:
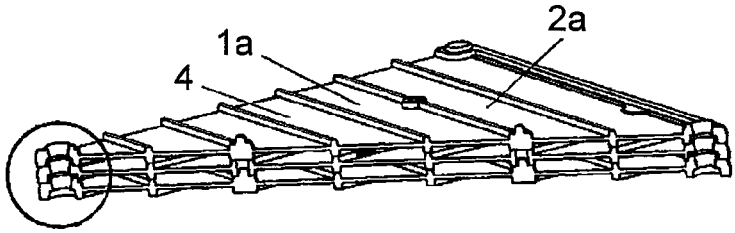
FIG. 6B is a schematic perspective view of the heat exchanger taken along line 6B-6B shown in FIG. 6A.
Figure 6C:
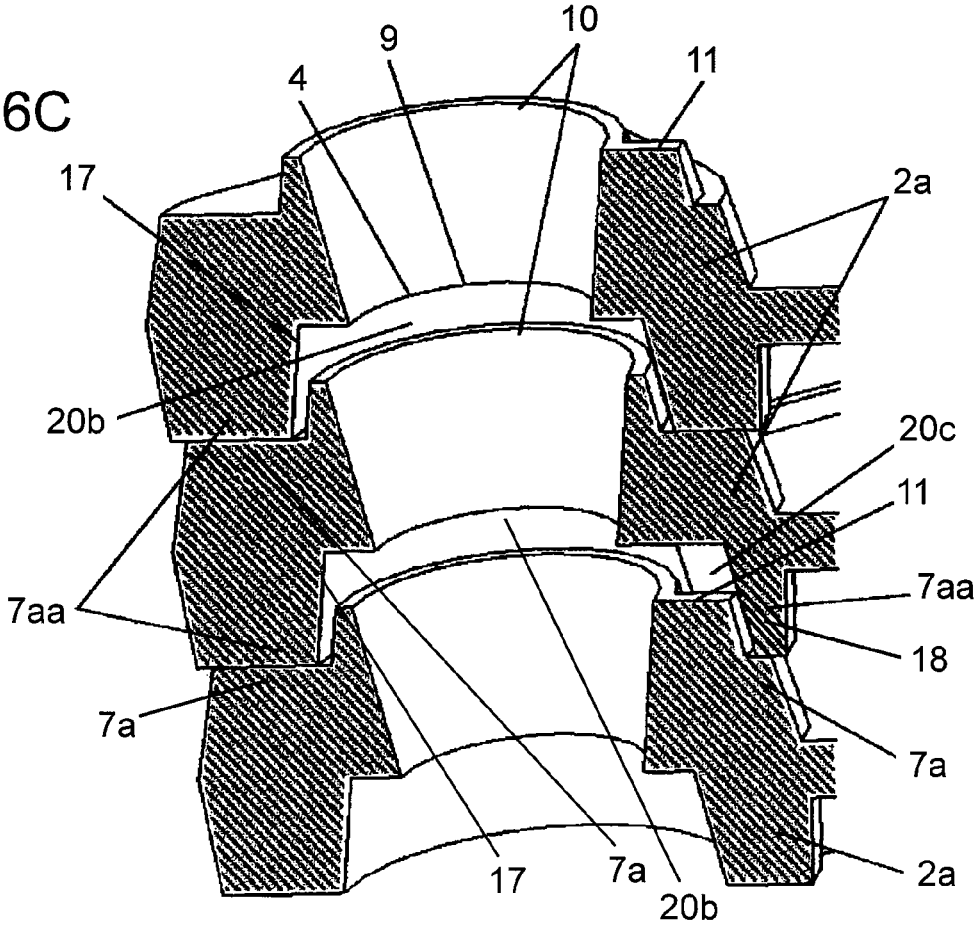
FIG. 6C is a schematic enlarged perspective view of a circled portion in FIG. 6B.
Figure 7A:
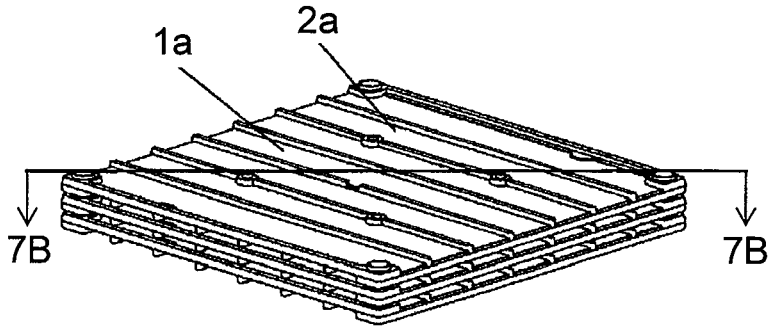
FIG. 7A is a schematic perspective view of the heat exchanger in which the unit elements of the heat exchanger shown in FIG. 1 are incorrectly stacked.
Figure 7B:
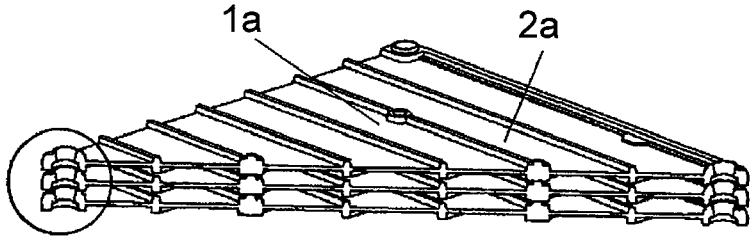
FIG. 7B is a schematic perspective view of the heat exchanger taken along line 7B-7B shown in FIG. 7A.
Figure 7C:
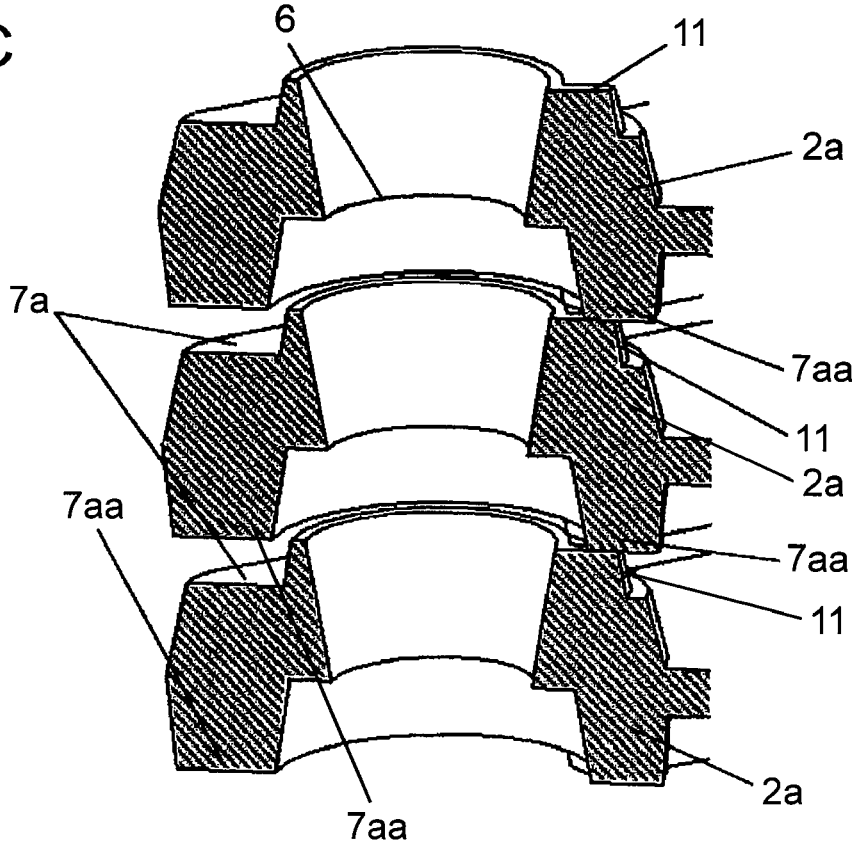
FIG. 7C is a schematic enlarged perspective view of a circled portion in FIG. 7B.
Figure 8:
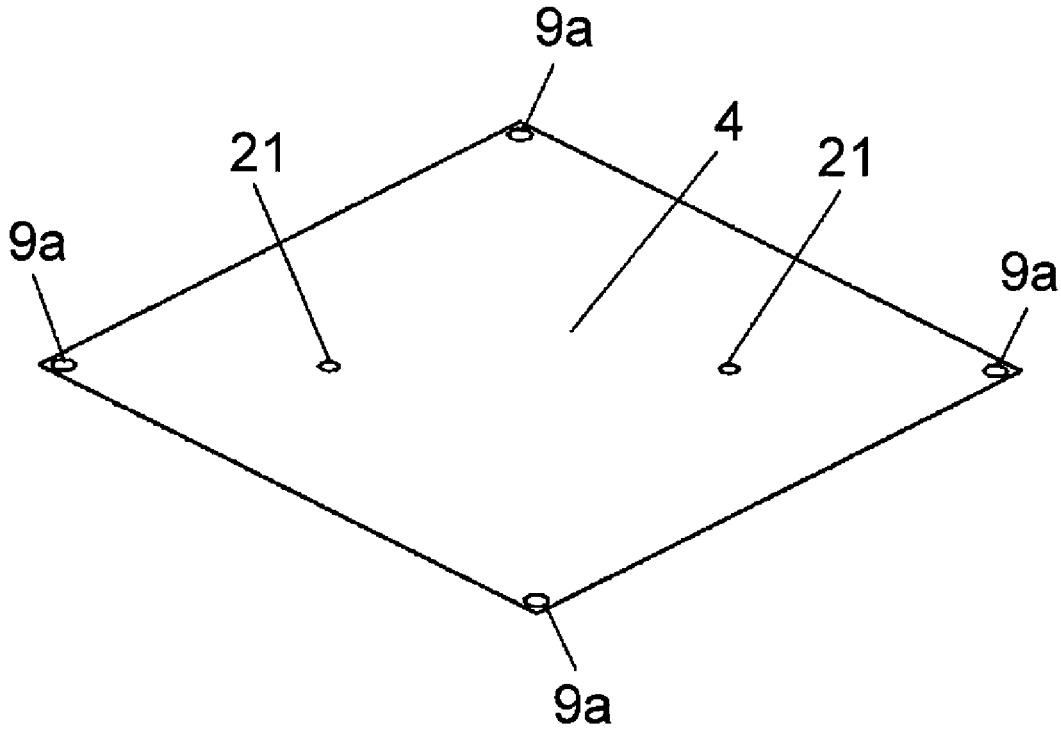
FIG. 8 is a schematic perspective view of a heat transfer plate of the heat exchanger shown in FIG. 1.

FIG. 6A is a schematic perspective view of the heat exchanger in which the unit elements of the heat exchanger shown in FIG. 1 are correctly stacked, FIG. 6B is a schematic perspective view of the heat exchanger taken along line 6B-6B shown in FIG. 6A, and FIG. 6C is a schematic enlarged perspective view of a circled portion in FIG. 6B. FIG. 7A is a schematic perspective view of the heat exchanger in which the unit elements of the heat exchanger shown in FIG. 1 are incorrectly stacked, FIG. 7B is a schematic perspective view of the heat exchanger taken along line 7B-7B shown in FIG. 7A, and FIG. 7C is a schematic enlarged perspective view of a circled portion in FIG. 7B. FIG. 8 is a schematic perspective view of a heat transfer plate of the heat exchanger shown in FIG. 1.

Figure 9A:
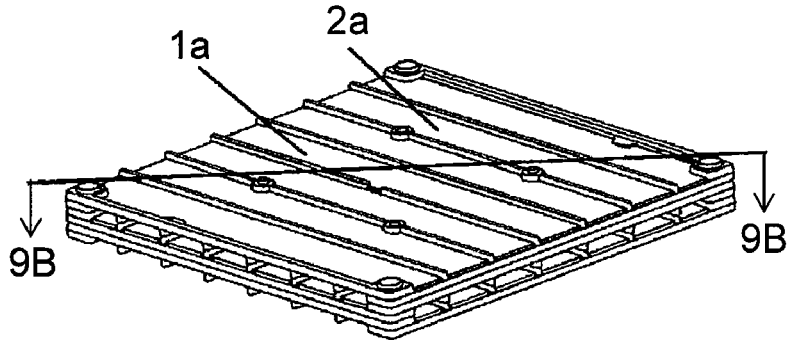
FIG. 9A is a schematic perspective view of the heat exchanger in which the unit elements of the heat exchanger shown in FIG. 1 are correctly stacked.
Figure 9B:
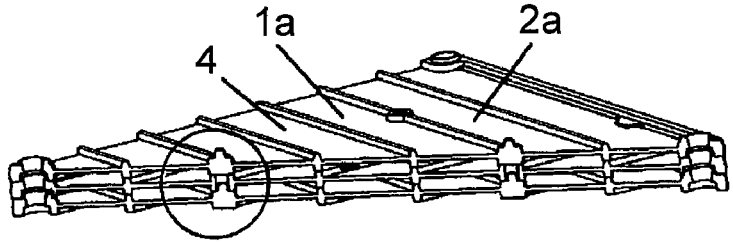
FIG. 9B is a schematic perspective view of the heat exchanger taken along line 9B-9B shown in FIG. 9A.
Figure 9C:
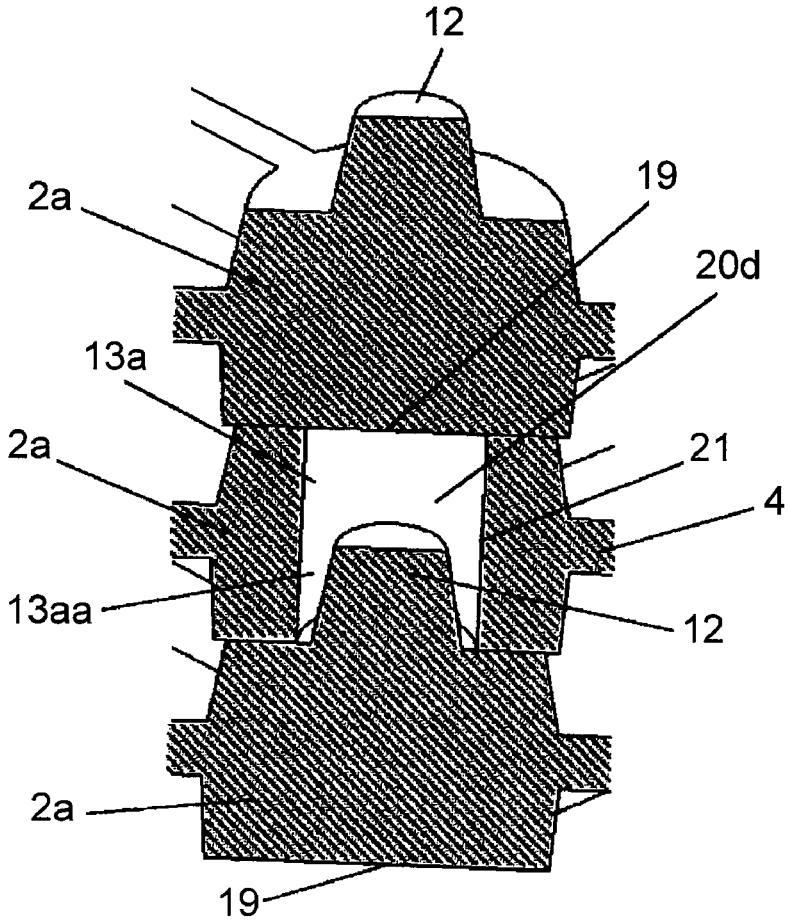
FIG. 9C is a schematic enlarged perspective view of a circled portion in FIG. 9B.
Figure 10A:
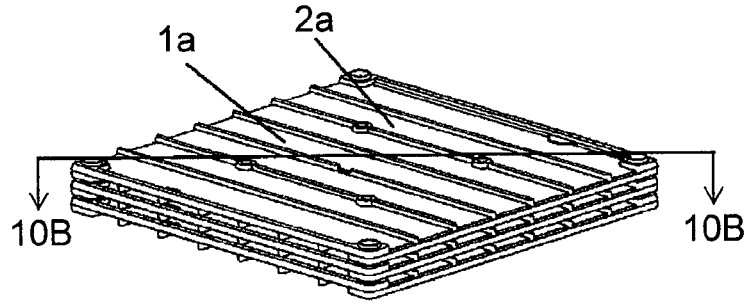
FIG. 10A is a schematic perspective view of the heat exchanger in which the unit elements of the heat exchanger shown in FIG. 1 are incorrectly stacked.
Figure 10B:
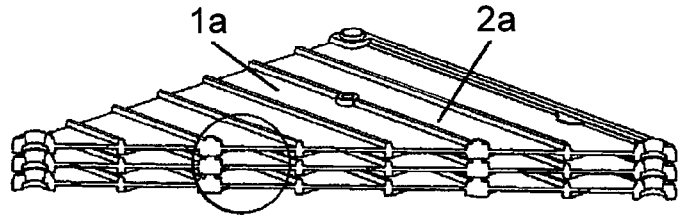
FIG. 10B is a schematic perspective view of the heat exchanger taken along line 10B-10B shown in FIG. 10A.
Figure 10C:
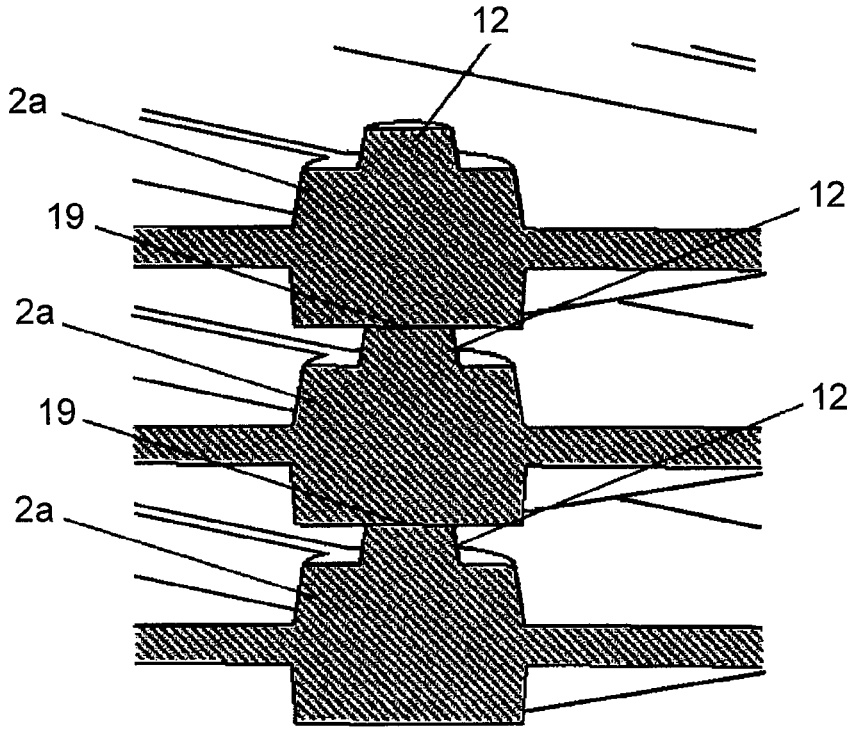
FIG. 10C is a schematic enlarged perspective view of a circled portion in FIG. 10B.
Figure 11:
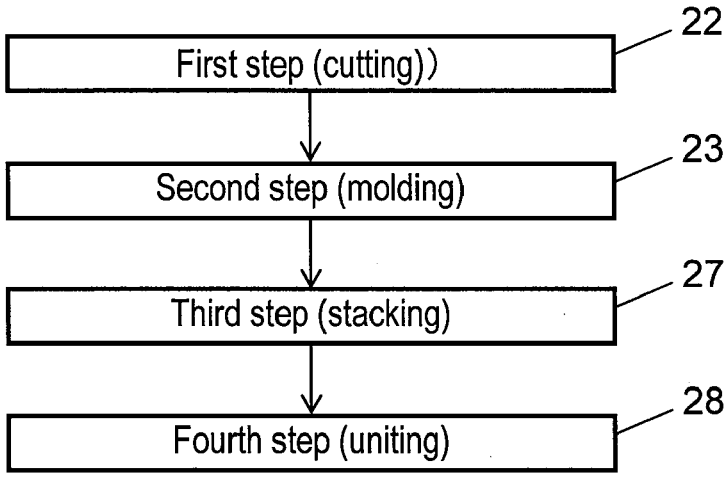
FIG. 11 is a schematic mass production step chart of the heat exchanger shown in FIG. 1.
Figure 12:
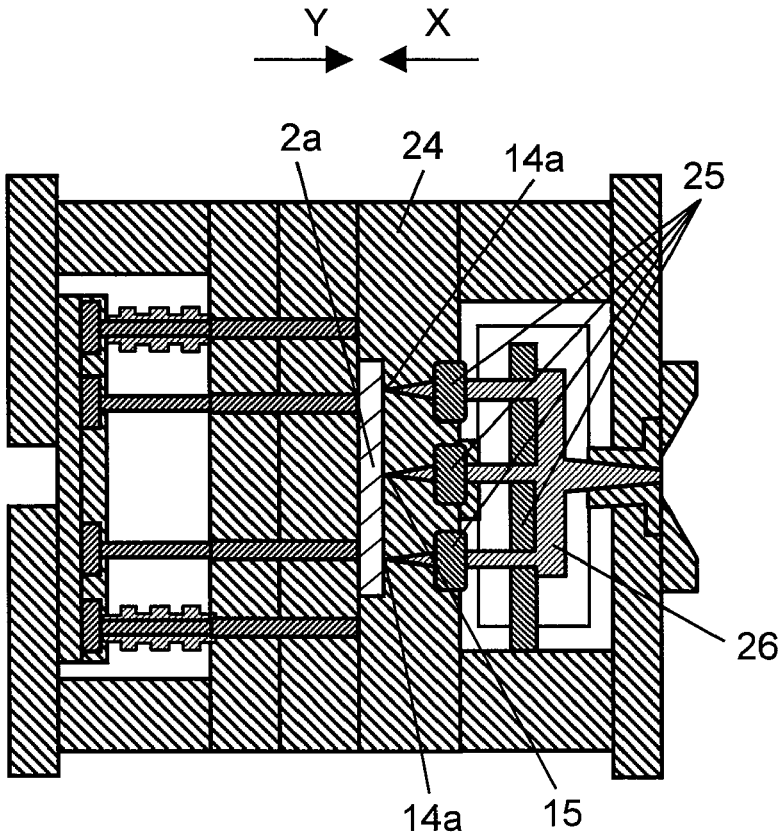
FIG. 12 is a schematic cross sectional view of an injection mold.
Figure 13A:
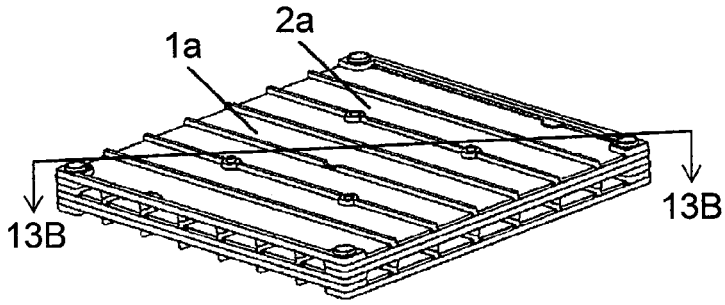
FIG. 13A is a schematic perspective view of the heat exchanger in which the unit elements of the heat exchanger shown in FIG. 1 are correctly stacked.
Figure 13B:
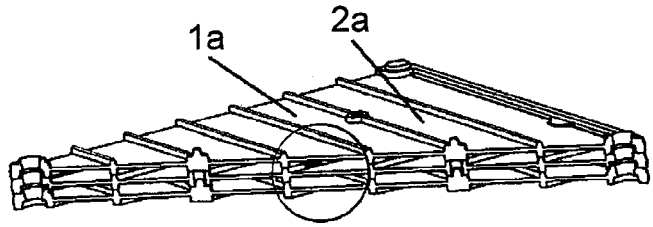
FIG. 13B is a schematic perspective view of the heat exchanger taken along line 13B-13B shown in FIG. 13A.
Figure 13C:
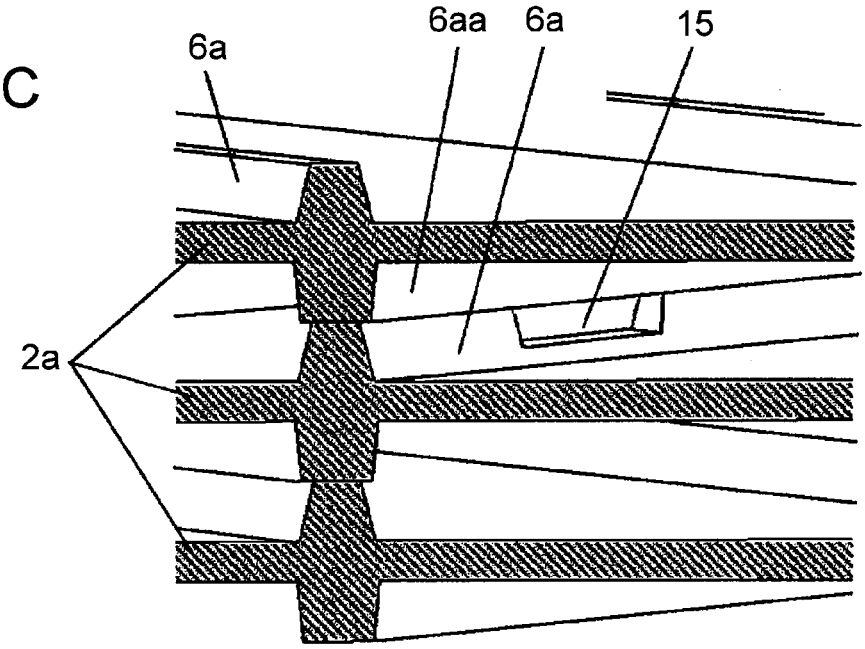
FIG. 13C is a schematic enlarged perspective view of a circled portion in FIG. 13B.

FIG. 9A is a schematic perspective view of the heat exchanger in which the unit elements of the heat exchanger shown in FIG. 1 are correctly stacked, FIG. 9B is a schematic perspective view of the heat exchanger taken along line 9B-9B shown in FIG. 9A, and FIG. 9C is a schematic enlarged perspective view of a circled portion in FIG. 9B. FIG. 10A is a schematic perspective view of the heat exchanger in which the unit elements of the heat exchanger shown in FIG. 1 are incorrectly stacked, FIG. 10B is a schematic perspective view of the heat exchanger taken along line 10B-10B shown in FIG. 10A, and FIG. 10C is a schematic enlarged perspective view of a circled portion in FIG. 10B. FIG. 11 is a schematic mass production step chart of the heat exchanger shown in FIG. 1, and FIG. 12 is a schematic cross sectional view of an injection mold. FIG. 13A is a schematic perspective view of the heat exchanger in which the unit elements of the heat exchanger shown in FIG. 1 are correctly stacked, FIG. 13B is a schematic perspective view of the heat exchanger taken along line 13B-13B shown in FIG. 13A, and FIG. 13C is a schematic enlarged perspective view of the heat exchanger of a circled portion in FIG. 13B.

In FIG. 1, FIGS. 2A and 2B, FIG. 3, FIGS. 4A, 4B, and 4C, heat exchanger 1*a* is configured by stacking square unit element 2*a* having one side of 120 mm and a thickness of 2.5 mm while alternately rotating by 90 degrees, and bonding unit elements 2*a* with supporting rod 3. When primary air current A and secondary air current B are flowed to ventilation path 5 formed between heat transfer plates 4, primary air current A and secondary air current B exchange heat while being orthogonal through heat transfer plate 4.

Unit element 2*a* shown in FIG. 2A and FIG. 2B includes first spacing rib 6*a*, first shield rib 7*a*, shield rib concave part 8, rib pass-through hole 9, pass-through hole convex part 10, stacking check convex part 11, positioning convex part 12, positioning pass-through hole 13*a*, shield rib injection port 14*a*, and spacing rib injection port 15 on the surface in the X-direction of heat transfer plate 4. Second spacing rib 6*aa*, second shield rib 7*aa*, rib pass-through hole 9, positioning pass-through hole 13*aa*, shield rib convex part 16, pass-through hole concave part 17, second shield rib 7*aa*, and positioning plane part 19 are arranged on the surface in the Y-direction of heat transfer plate 4. First spacing rib 6*a*, second spacing rib 6*aa*, and first shield rib 7*a*, second shield rib 7*aa* are formed by being integrally molded with resin so as to sandwich heat transfer plate 4 in between.

On the surface in the X-direction of heat transfer plate 4, six first spacing ribs 6*a* are formed at a predetermined interval at a height of 1 mm and a width of 1 mm, and first shield rib 7*a* is formed into a height of 1 mm and a width of 5 mm in parallel to first spacing rib 6*a* at a set of ends facing each other of heat transfer plate 4. Shield rib concave part 8 is formed into a concave shape along ventilation path 5 to a concave height of 0.5 mm and a width of 2.5 mm on the upper surface of first shield rib 7*a*, and the cross sections of first shield rib 7*a* and shield rib concave part 8 are formed into a step-shape. Shield rib injection port 14*a* has a trapezoid shape and couples with first shield rib 7*a*, is formed in ventilation path 5, and is formed into the same convex height as shield rib concave part 8. Rib pass-through hole 9 is at four corners of unit element 2*a*, where a hole is formed in first shield rib 7*a*, and pass-through hole convex part 10 having a convex height of 0.4 mm is arranged at the periphery of the hole of rib pass-through hole 9. Stacking check convex part 11 is coupled to pass-through hole convex part 10, and is arranged at a convex height of 0.4 mm at two opposing locations of square unit element 2*a*. Two positioning convex parts 12 are arranged at a convex height of 1.7 mm on the upper surface of first spacing rib 6*a*, positioning pass-through hole 13*a* has two cylinders arranged at a convex height of 1.0 mm at first spacing rib 6*a*, and spacing rib injection port 15 is formed into a shape of lowering the step of first spacing rib 6*a* to a concave height of 0.5 mm on the upper surface of first spacing rib 6*a*.

On the surface in the Y-direction of heat transfer plate 4, six second spacing ribs 6*aa* are formed at a predetermined interval orthogonal to first spacing rib 6*a* at a height of 1 mm and a width of 1 mm, and second shield rib 7*aa* is formed into a height of 1 mm and a width of 5 mm in parallel to second spacing rib 6*aa* at a set of ends facing each other of heat transfer plate 4. Shield rib convex part 16 is formed into a convex shape along ventilation path 5 at a convex height of 0.4 mm and a width of 2.4 mm on the upper surface of second shield rib 7*aa*, and the cross sections of second shield rib 7*aa* and shield rib convex part 16 are formed into a step-shape. Rib pass-through hole 9 is at four corners of unit element 2*a*, where a hole is formed in second shield rib 7*aa*, and pass-through hole concave part 17 having a concave height of 0.5 mm is arranged at the periphery of the hole of rib pass-through hole 9. Second shield rib 7*aa* is coupled to pass-through hole concave part 17, and is arranged at a concave height of 0.5 mm at two opposing locations of square unit element 2*a*. Positioning plane part 19 has a circular column having a convex height of 1.0 mm arranged at two locations on the opposite side of positioning convex part 12 with heat transfer plate 4 in between, and positioning pass-through hole 13*aa* has two cylinders arranged at a convex height 1.0 mm on the opposite sides of positioning pass-through hole 13*a* with heat transfer plate 4 in between.

As shown in FIGS. 4A, 4B, and 4C, first spacing rib 6*a* and second spacing rib 6*aa* are formed so that adjacent first spacing rib 6*a* and second spacing rib 6*aa* overlap each other when unit elements 2*a* are stacked while being alternately rotated by 90 degrees, and have a function of holding heat transfer plate 4 at a constant spacing. In the present embodiment, heat transfer plate 4 is stacked every 2 mm since the convex height of first spacing rib 6*a* and second spacing rib 6*aa* is 1 mm.

As shown in FIGS. 4A, 4B, and 4C, first shield rib 7*a* and second shield rib 7*aa* are formed so that adjacent first shield rib 7*a* and second shield rib 7*aa* overlap each other when unit elements 2*a* are stacked while being alternately rotated by 90 degrees. First shield rib 7*a* and second shield rib 7*aa* have a function of shielding primary air current A and second air current B flowing through ventilation path 5 of heat exchanger 1*a* so that air current does not leak out from the end face of heat exchanger 1*a*, and a function of holding heat transfer plate 4 at a constant spacing.

First shield rib 7*a* and second shield rib 7*aa* are formed at both ends of square unit element 2*a* to obtain a wide heat transfer plate 4 of heat exchanger 1*a* within a constant capacity, but may be appropriately determined according to the design of the heat exchanger, the mass productivity, and the like.

As shown in FIGS. 4A, 4B, and 4C, shield rib concave part 8 and shield rib convex part 16 are formed so that the concave part of shield rib concave part 8 and the convex part of shield rib convex part 16 adjacent to each other are fitted when unit elements 2*a* are correctly stacked while being alternately rotated by 90 degrees. In heat exchanger 1*a*, unit elements 2*a* are fixed to each other, and positional shift that occurs when stacking unit element 2*a* is prevented by the fit-in of shield rib concave part 8 and shield rib convex part 16 arranged on first shield rib 7*a* and second shield rib 7*aa*. The shielding of air current at the side surface of heat exchanger 1*a* is carried out by overlapping of first shield rib 7*a* and second shield rib 7*aa* adjacent to each other as shown in FIG. 4C, where the fit-in of the concave part of shield rib concave part 8 and the convex part of shield rib convex part 16 also shield the air current.

In this specification, first shield rib 7*a* and second shield rib 7*aa* are always made to overlap, and the fit-in of shield rib concave part 8 and shield rib convex part 16 is arranged with stacking escape part 20*a* of 0.1 mm in the height direction in such a manner that the air current does not leak out in view of manufacturing precision of the die and the precision of the resin mold. Stacking escape part 20*a* is arranged in the height direction of 0.1 mm, however, it can be adapted as long as shielding of air current at the side surface of heat exchanger 1*a* and the fit-in of unit elements 2*a* are fitted to each other when unit elements 2*a* are correctly stacked. Accordingly it is appropriately determined according to the design of the heat exchanger and the manufacturing precision.

As shown in FIGS. 5A and 5B, if unit elements 2*a* are incorrectly stacked without being alternately rotated by 90 degrees, the convex part of shield rib convex part 16 interferes with adjacent first spacing rib 6*a*, and adjacent unit elements 2*a* cannot be fitted together. Checking from the side surface of heat exchanger 1*a*, a gap forms between unit elements 2*a*, and thus incorrect stacking of unit elements 2*a* can be easily checked.

Heat exchanger 1*a* includes shield rib concave part 8 and shield rib convex part 16 in first shield rib 7*a* and second shield rib 7*aa* as a stacking error detection unit for easily determining the stacking error when unit elements 2*a* are stacked. Thus, when unit elements 2*a* are correctly stacked, the concave part of shield rib concave part 8 and the convex part of shield rib convex part 16 of adjacent unit elements 2*a* fit to each other. If incorrectly stacked, the convex part of shield rib convex part 16 and one part (first spacing rib 6*a*) of adjacent unit element 2 interfere, and thus stacking error of unit element 2*a* can be easily checked.

Shield rib concave part 8 and shield rib convex part 16 are arranged on first shield rib 7*a* and second shield rib 7*aa* of unit element 2*a*, but the configuration is not limited thereto. As long as a structure is made in such a way that the concave part and the convex part of the adjacent unit elements fit to each other when the unit elements are correctly stacked, and that the convex part and one part of the adjacent unit element interfere when they are incorrectly stacked, similar effects can be obtained even if heat exchangers of other configurations are used.

Interfere in the present specification refers to a state in which the convex part and one part of adjacent unit element 2*a* contact when unit elements 2*a* are incorrectly stacked, and adjacent unit elements 2*a* cannot be fitted thereby forming a gap. When unit elements 2*a* are correctly stacked, this refers to a state in which the fit-in structure of the concave part and the convex part arranged in unit element 2*a* fits to each other, air current leakage does not occur, and the basic performance of the heat exchanger can be exhibited. When unit elements 2*a* are incorrectly stacked, this refers to a state in which the concave part arranged on unit element 2*a* and one part of unit element 2*a* interfere, a gap forms between adjacent unit elements 2*a*, air current leakage occurs, and the basic performance of the heat exchanger cannot be exhibited.

As shown in FIGS. 6A, 6B, and 6C, pass-through hole concave part 17 and pass-through hole convex part 10 are formed such that the concave part of pass-through hole concave part 17 and the convex part of pass-through hole convex part 10 adjacent to each other fit to each other when unit elements 2*a* are correctly stacked while being alternately rotated by 90 degrees. In heat exchanger 1*a*, unit elements 2*a* are fixed to each other, and positional shift that occurs when stacking unit elements 2*a* is prevented by the fit-in of pass-through hole concave part 17 and pass-through hole convex part 10 arranged at four corners of unit element 2*a*. The shield of the air current at the four corners of heat exchanger 1*a* is performed by overlapping adjacent first shield rib 7*a* and second shield rib 7*aa* as shown in FIG. 6C, and the fit-in of the concave part of pass-through hole concave part 17 and the convex part of pass-through hole convex part 10 also shield the air current.

In this specification, first shield rib 7*a* and second shield rib 7*aa* are always made to overlap each other, and the fit-in of pass-through hole concave part 17 and pass-through hole convex part 10 is arranged with stacking escape part 20*b* of 0.1 mm in the height direction in such a manner that the air current does not leak out in view of the manufacturing precision of the die and the precision of the resin mold. Stacking escape part 20*b* in the height direction of 0.1 mm is arranged, however, it can be adapted as long as shielding of air current at the four corners of heat exchanger 1*a* and the fit-in of unit elements 2*a* are fitted to each other when unit elements 2*a* are correctly stacked. Accordingly it is appropriately determined according to the design of the heat exchanger and the manufacturing precision.

Pass-through hole concave part 17 and pass-through hole convex part 10 are arranged at the four corners of unit element 2*a*, but the configuration is not limited thereto. As long as a structure is made in such a way that the concave part and the convex part of the adjacent unit elements fit, and that at least one of the spacing rib and the shield rib or at least one of the spacing rib and the shield rib is coupled when the unit elements are correctly stacked, similar effects can be obtained even if heat exchangers of other configurations are used.

As shown in FIGS. 6A, 6B, and 6C, second shield rib 7*aa* and stacking check convex part 11 are formed such that the concave part of second shield rib 7*aa* and the convex part of stacking check convex part 11 adjacent to each other fit to each other when unit elements 2*a* are correctly stacked while being alternately rotated by 90 degrees. In heat exchanger 1*a*, unit elements 2*a* are fixed, and positional shift that occurs when stacking unit elements 2*a* is prevented by the fit-in of second shield rib 7*aa* and stacking check convex part 11 arranged at two opposing locations of square unit element 2*a*. The shield of the air current at the four corners of heat exchanger 1*a* is performed by overlapping adjacent first shield rib 7*a* and second shield rib 7*aa* as shown in FIG. 6C, and fit-in of the concave part of second shield rib 7*aa* and the convex part of stacking check convex part 11 also shield the air current.

In this specification, first shield rib 7*a* and second shield rib 7*aa* are always made to overlap each other, and the fit-in of second shield rib 7*aa* and stacking check convex part 11 is arranged with stacking escape part 20*c* of 0.1 mm in the height direction in such a manner that the air current does not leak in view of the manufacturing precision of the die and the precision of the resin mold. Stacking escape part 20*c* in the height direction of 0.1 mm is arranged, however, it can be adapted as long as shielding of air current at the four corners of heat exchanger 1*a* and the fit-in of unit elements 2*a* are fitted to each other when unit elements 2*a* are correctly stacked. Accordingly it is appropriately determined according to the design of the heat exchanger and the manufacturing precision.

As shown in FIGS. 7A, 7B, and 7C, if unit elements 2*a* are incorrectly stacked without being alternately rotated by 90 degrees, the convex part of stacking convex part 11 interferes with adjacent second shield rib 7*aa*, and adjacent unit elements 2*a* cannot be fitted. Checking from the side surface of heat exchanger 1*a*, a gap forms between unit elements 2*a*, and the stacking error of unit elements 2*a* can be easily checked.

Second shield rib 7*aa* and stacking check convex part 11 are arranged by twos respectively at the opposing corners of unit element 2*a*, but the configuration is not limited thereto. As long as a structure is made in such a way that the concave part and the convex part of the adjacent unit elements fit to each other when the unit elements are correctly stacked, and that the convex part and one part of the adjacent unit element interfere when they are incorrectly stacked, similar effects can be obtained even if heat exchangers of other configurations are used.

Heat transfer plate 4 shown in FIG. 8 is a square having one side of 119 mm, where the thickness is 0.2 to 0.01 mm, and preferably 0.1 to 0.01 mm. The material may be Japanese paper, heat shield paper, special processed paper having heat transfer property, moisture permeability, and gas shielding property, moisture permeable film, or resin sheet such as polyester, polystyrene ABS, AS, PS, polyolefin PP, PE etc. having only heat transfer property, resin film, and the like. Four heat transfer plate pass-through holes 9*a* are arranged at four corners of heat transfer plate 4, and two positioning holes 21 are formed on one diagonal line of square heat transfer plate 4, where heat transfer plate 4 is inserted to a resin die, and unit element 2*a* is integrally molded using insert injection molding. When inserting heat transfer plate 4 into the resin die, a pin for positioning and fixing heat transfer is arranged in the resin die, so that the positioning of heat transfer plate 4 is carried out by the pin of the resin die and positioning hole 21 of heat transfer plate 4.

As shown in FIGS. 9A, 9B, and 9C, positioning pass-through holes 13*a*, 13*aa* are formed at the periphery of positioning hole 21 of heat transfer plate 4, and the convex part of positioning convex part 12 is formed into fit with adjacent positioning pass-through holes 13*a*, 13*aa* when unit elements 2*a* are correctly stacked while being alternately rotated by 90 degrees. Positioning plane part 19 is formed so as to block the hole of adjacent positioning pass-through hole 13*a*.

In heat exchanger 1*a*, unit elements 2*a* are fixed to each other, and positional shift that occurs when stacking unit element 2*a* is prevented by the fit-in of positioning pass-through holes 13*a*, 13*aa* and positioning convex part 12 arranged on the diagonal line of unit element 2*a*. The shielding of air current at the central part of heat exchanger 1*a* is carried out by overlapping positioning plane part 19 and the convex part lower surface of positioning pass-through hole 13*a* and positioning convex part 12 and positioning pass-through hole 13*aa* adjacent to each other as shown in FIG. 9C. The fit-in of the hole of positioning pass-through hole 13*a*, 13*aa* and the convex part of positioning convex part 12 also shield the air current.

In this specification, positioning plane part 19, positioning pass-through hole 13*a* and the convex part lower surface of positioning convex part 12, and positioning pass-through hole 13*aa* are always made to overlap each other in view of the manufacturing precision of the die and the precision of the resin mold. The fit-in of positioning pass-through hole 13*a*, 13*aa* and positioning convex part 12 is arranged with stacking escape part 20*d* of 0.3 mm in the height direction in such a manner that the air current does not leak. Stacking escape part 20*d* in the height direction of 0.3 mm is arranged, however, it can be adapted as long as shielding of air current at the central part of heat exchanger 1*a* and the fit-in of unit elements 2*a* are fitted to each other when unit elements 2*a* are correctly stacked. Accordingly it is appropriately determined according to the design of the heat exchanger and the manufacturing precision.

As shown in FIGS. 10A, 10B, and 10C, if unit elements 2*a* are incorrectly stacked without being alternately rotated by 90 degrees, the convex part of positioning convex part 12 interferes with adjacent positioning plane part 19 and adjacent unit elements 2*a* cannot fitted. Checking from the side surface of heat exchanger 1*a*, a gap forms between unit elements 2*a*, and the stacking error of unit elements 2*a* can be easily checked.

Positioning pass-through holes 13*a*, 13*aa*, positioning convex part 12, and positioning plane part 19 are arranged by twos respectively on the diagonal line of unit element 2*a*, but the configuration is not limited thereto. As long as a structure is made in such a way that the hole and the convex part of the adjacent unit elements fit to each other when the unit elements are correctly stacked, and that the convex part and one part of the adjacent unit element interfere when they are incorrectly stacked, similar effects can be obtained even if heat exchangers of other configurations are used.

As shown in FIG. 6C and FIG. 8, in unit element 2*a* formed by integrally molding heat transfer plate 4 and the resin, a hole passing through unit element 2*a* is formed with heat transfer plate pass-through hole 9*a* of heat transfer plate 4 at the same position as heat transfer plate pass-through hole 9*a* of first shield rib 7*a* and second shield rib 7*aa*, and pass-through hole convex part 10 and pass-through hole concave part 17 are formed at the periphery of such hole.

As shown in FIG. 6C and FIG. 9C, rib pass-through hole 9, pass-through hole convex part 10, and pass-through hole concave part 17 are formed at positions coupling to first shield rib 7*a* and second shield rib 7*aa*. Positioning pass-through holes 13*a*, 13*aa*, positioning convex part 12, and positioning plane part 19 are formed at positions coupling to first spacing rib 6*a* and second spacing rib 6*aa*. Therefore, unit element 2*a* including the above can be formed in one resin molding.

Rib pass-through hole 9, pass-through hole convex part 10 and pass-through hole concave part 17 are formed at positions coupling to first shield rib 7*a* and second shield rib 7*aa*, and positioning pass-through holes 13*a*, 13*aa*, positioning convex part 12, and positioning plane part 19 are formed at positions coupling to first spacing rib 6*a* and second spacing rib 6*aa*. However, rib pass-through hole 9, pass-through hole convex part 10, pass-through hole concave part 17, positioning pass-through holes 13*a*, 13*aa*, positioning convex part 12, and positioning plane part 19 merely need to be arranged at positions coupling to at least one of first spacing rib 6*a*, second spacing rib 6*aa*, or first shield rib 7*a*, second shield rib 7*aa*.

They may be arranged at positions coupling to at least one of first spacing rib 6*a*, second spacing rib 6*aa*, and first shield rib 7*a*, second shield rib 7*aa*. In other words, when obtaining unit element 2*a* by integrally molding heat transfer plate 4 and resin, they merely need to be integrally formed with one resin molding, and similar effects can be obtained using other configurations.

Manufacturing steps and manufacturing method of heat exchanger 1*a* are shown in FIG. 11 and FIG. 12. In first step (cutting) 22, the heat transfer plate material is cut to a predetermined size to obtain heat transfer plate 4.

In second step (molding) 23, heat transfer plate 4 is inserted to injection mold 24, and unit element 2*a* is obtained through an insert injection molding method of integrally molding heat transfer plate 4 and resin with an injection molding machine. Thermoplastic resin may be applied for the resin, and the type of resin may be polyester, polystyrene ABS, AS, PS, or polyolefin PP, PE, and the like. The resin having inorganic filler of glass fiber or carbon fiber added to thermoplastic resin may be used. The adding amount of the inorganic filler is 1 to 50% by weight with respect to the weight of the resin, and more preferably 10 to 30% by weight. If inorganic filler is added to the resin, strength and physicality of warp or contractility of unit element 2*a* of resin molded article enhance, and adherence of heat transfer plate 4 and resin that are integrally molded enhances.

This is not enhancement of adherence by chemical bonds, but enhancement of physical bonds in which intertwining of fibers of the inorganic filler and heat transfer plate 4 is stronger. If greater amount of adding amount of the inorganic filler is mixed with respect to the weight of the resin, the strength and the physicality of warp and contractility of the resin molded article enhance, but when becoming greater than or equal to 50% by weight, the resin molded article may not be obtained since the fluidity of the molten resin in time of injection molding lowers. The adding amount of the inorganic filler is appropriately determined according to specifications etc. of the necessary strength of the resin molded article, resin physicality, and injection molding machine.

In second step (molding) 23, when injected into the injection mold 24 from the X-direction of heat transfer plate 4, the molten resin passes through the resin flow path, and flows into shield rib injection port 14*a* and spacing rib injection port 15 arranged at unit element 2*a* from a gate part of the die. Furthermore, as molten resin has high injection pressure, it can be formed in a manner the molten resin molds first spacing rib 6*a* and first shield rib 7*a* on the surface in the X-direction of heat transfer plate 4, passes through heat transfer plate 4 made of paper such as Japanese paper, and couples to second spacing rib 6*aa* and second shield rib 7*aa* on the surface in the Y-direction of heat transfer plate 4. Therefore, unit element 2*a* with heat transfer plate 4, first spacing rib 6*a*, second spacing rib 6*aa*, first shield rib 7*a*, and second shield rib 7*aa* can be formed in one molding.

Injection mold 24 for resin molding unit element 2*a* includes a means for realizing runnerless, where an open gate type or a valve gate type hot runner is used as a means for realizing runnerless. The molten resin is constantly is maintained in a liquid state by heat controlling the runner/gate part by heater 25, and thus spool runner 26, which becomes a waste material in time of resin molding, does not produce, thereby reducing the resin material cost and saving resource. The molding cycle can be shortened since only unit element 2*a* of a molded article can be successively taken out from injection mold 24.

The spool in this specification refers to a conical portion at one part of the flow path of the molding material in injection mold 24, and runner refers to a portion from the spool to the gate of the path for flowing in the molten resin into a cavity in injection mold 24.

The valve gate type hot runner has a gate open/close function, and thus burr does not form at shield rib injection port 14*a* and spacing rib injection port 15 of unit element 2*a* through which the molten resin is injected from injection mold 24. Therefore, adjacent unit elements 2*a* do not interfere by the burr when unit elements 2*a* are stacked, and unit elements 2*a* can be stacked without forming a gap.

Third step (stacking) 27 is a step of stacking unit elements 2*a* while alternately rotating by 90 degrees, and inserting supporting rod 3 to rib pass-through hole 9 formed at the four corners of unit element 2*a*.

Fourth step (uniting) 28 is a step of obtaining heat exchanger 1*a* by annexing a retaining tool to both ends of supporting rod 3 inserted to rib pass-through hole 9 and uniting unit elements 2*a*. Supporting rod 3 is made of thermoplastic resin, where both ends of supporting rod 3 are melted by heat and solidified with while tightening unit elements 2*a* to unite the same. Uniting in the present invention refers to solidifying unit elements 2*a* through mechanical or thermal restraint.

Heat exchanger 1*a* includes shield rib injection port 14*a* and spacing rib injection port 15 for injecting the molten resin at positions coupling to first spacing rib 6*a* and first shield rib 7*a*, and a has a configuration of coupling at one of first spacing rib 6*a*, second spacing rib 6*aa*, and first shield rib 7*a*, second shield rib 7*aa*. Shield rib injection port 14*a* and spacing rib injection port 15 include a stacking escape part so that adjacent unit elements 2*a* do not interfere when unit elements 2*a* are stacked, where a lowered step is formed at first spacing rib 6*a* and first shield rib 7*a* as the stacking escape part. Shield rib injection port 14*a* is formed in ventilation path 5 that couples to first shield rib 7*a* as the lowered step.

As shown in FIGS. 4A, 4B, and 4C, since shield rib injection port 14*a* has the lowered step formed in ventilation path 5, even if the burr forms at shield rib injection port 14*a* injected with the molten resin from the die, the butt is escaped by the lowered step and adjacent unit elements 2*a* do not interfere when unit elements 2*a* are stacked. As the burr is positioned in ventilation path 5, interference is further avoided by escaping the burr by a space of ventilation path 5 with adjacent unit element 2*a*, and unit elements 2*a* can be stacked without forming a gap.

As shown in FIGS. 13A, 13B, and 13C, spacing rib injection port 15 formed in first spacing rib 6*a* overlap adjacent second spacing rib 6*aa* when unit elements 2*a* are correctly stacked while alternately rotating by 90 degrees. Spacing rib injection port 15 has a shape of a having first spacing rib 6*a* as lowered step to a concave height of 0.5 mm at the upper surface of first spacing rib 6*a*. Therefore, even if the burr forms at spacing rib injection port 15 injected with the molten resin from the die, unit elements 2*a* do not interfere by escaping the burr by the stacking escape part when stacking unit elements 2*a*, and unit elements 2*a* can be stacked without forming a gap.

The lowered step in this specification refers to lowering the convex height from the peripheral resin rib so that adjacent unit elements 2*a* do not interfere when stacking unit elements 2*a* even in an event the burr formed at the injection port through which the molten resin is injected to unite element 2*a* from the die.

The lowered step of spacing rib injection port 15 is formed on the upper surface of first spacing rib 6*a*, and the lowered step of shield rib injection port 14*a* is formed so as to couple to first shield rib 7*a*, but the configuration is not limited thereto. The injection port for injecting the molten resin merely needs to have a configuration of coupling to at least one of first spacing rib 6*a* and first shield rib 7*a*, arranging in ventilation path 5, and forming a lowered step so as to escape the burr, and similar effects can be obtained by using other configurations.

According to such configuration, heat exchanger 1*a* includes shield rib concave part 8 and shield rib convex part 16 on first shield rib 7*a* and second shield rib 7*aa* as a stacking error detecting unit capable of easily determining the stacking error when unit elements 2*a* are stacked. Thus, the concave part of shield rib concave part 8 and the convex part of shield rib convex part 16 of adjacent unit elements 2*a* fit to each other when unit elements 2*a* are correctly stacked. Therefore, the convex part of shield rib convex part 16 and one part of adjacent unit element 2*a* (first spacing rib 6*a*) interfere when they are incorrectly stacked. Therefore, the stacking error of unit element 2*a* can be easily checked, the failure in production can be reduced by correcting the stacking error, and the mass productivity can be enhanced.

The lowering in sealing property caused by the stacking error of unit elements 2*a* can be prevented, and the leakage of the air current can be prevented. The concave part of shield rib concave part 8 and the convex part of shield rib convex part 16 have the concave part and the convex part fitted to each other when stacking unit elements 2*a*, thereby fixing unit elements 2*a* to each other. Therefore, lowering in sealing property caused by the shift of unit element 2*a* can be prevented, the leakage of the air current can be prevented, and the positional shift that occurs when stacking unit elements 2*a* is prevented by the fit-in structure, whereby the mass productivity can be enhanced.

According to the stacking error of unit elements 2*a*, if ventilation path 5 is formed in the same direction for every heat transfer plate 4, and primary air current A and secondary air current B are flowed to heat exchanger 1*a*, heat is not exchanged at the incorrectly stacked portion. The lowering in heat conversion efficiency caused by the matter that ventilation path 5 cannot be correctly formed for every heat transfer plate 4 due to the stacking error of unit element 2*a* is prevented by arranging the stacking error detecting unit capable of easily determining the stacking error when unit elements 2*a* are stacked.

Heat exchanger 1*a* includes rib pass-through hole 9, pass-through hole concave part 17 and pass-through hole convex part 10, and second shield rib 7*aa* and stacking check convex part 11 in unit element 2*a* as the stacking error detecting unit, where pass-through hole concave part 17 and pass-through hole convex part 10 are fitted to each other when stacking unit elements 2*a*. Unit elements 2*a* are thereby fixed to each other, so that lowering in sealing property caused by the shift of unit element 2*a* can be prevented, and the leakage of the air current can be prevented.

The fit-in structure arranged at the periphery of rib pass-through hole 9 prevent the positional shift that occurs when stacking unit elements 2*a* thereby enhancing mass productivity. Furthermore, second shield rib 7*aa* and stacking check convex part 11 of adjacent unit elements 2*a* fit to each other when unit elements 2*a* are correctly stacked, and stacking check convex part 11 and one part of adjacent unit element 2*a* (second shield rib 7*aa*) interference when they are incorrectly stacked, and thus the stacking error of unit element 2*a* can be easily checked. The failure in production can be reduced by correcting the stacking error, and the mass productivity can be enhanced.

The lowering in sealing property caused by the stacking error of unit elements 2*a* can be prevented, and the leakage of the air current can be prevented. The second shield rib 7*aa* and stacking check convex part 11 fit to each other when stacking unit elements 2*a*, thereby fixing unit elements 2*a* to each other. Therefore, lowering in sealing property caused by the shift of unit element 2*a* can be prevented, the leakage of the air current can be prevented, and the positional shift that occurs when stacking unit elements 2*a* is prevented by the fit-in structure, whereby the mass productivity can be enhanced.

Heat exchanger 1*a* can prevent lowering in sealing property caused by the shift of unit element 2*a* and the leakage of air current can be prevented by passing supporting rod 3 through rib pass-through hole 9 when unit elements 2*a* are stacked, and uniting unit elements 2*a*.

Furthermore, heat exchanger 1*a* includes positioning hole 21 in heat transfer plate 4, and positioning pass-through holes 13*a*, 13*aa* and positioning convex part 12 and positioning plane part 19 in unit element 2*a*. Thus, when the insert injection molding of inserting heat transfer plate 4 into the die and then performing injection molding is used, the hole of positioning hole 21 formed in heat transfer plate 4 allows positioning when inserting heat transfer plate 4 to the resin die to be easily performed, and mass productivity can be enhanced. The hole of positioning pass-through holes 13*a*, 13*aa*, and the convex part of positioning convex part 12 of adjacent unit elements 2*a* fit to each other when unit elements 2*a* are correctly stacked.

If incorrectly stacked, the convex part of positioning convex part 12 and one part of unit element 2*a* (positioning plane part 19) interfere, and thus the stacking error of unit element 2*a* can be easily checked, the failure in production can be reduced by correcting the stacking error, and the mass productivity can be enhanced. Thus, the lowering in sealing property caused by the stacking error of unit element 2*a* can be prevented, and the leakage of air current can be prevented.

With respect to the pass-through hole and the convex part, the hole of positioning pass-through holes 13*a*, 13*aa* and the convex part of convex part 12 fitted when stacking unit elements 2*a*, thereby fixing unit elements 2*a* to each other. Therefore, lowering in sealing property caused by the shift of unit element 2*a* can be prevented, the leakage of the air current can be prevented, and the positional shift that occurs when stacking unit elements 2*a* is prevented by the fit-in structure, whereby the mass productivity can be enhanced.

Heat exchanger 1*a* have first spacing rib 6*a*, second spacing rib 6*a*, and first shield rib 7*a*, second shield rib 7*aa* of unit element 2*a* coupled at one of the above, and thus unit element 2*a* having therewith is integrally formed with one resin molding, and mass productivity can be enhanced. If insert injection molding of inserting heat transfer plate 4 in the die and then performing injection molding is used, heat transfer plate 4 and first spacing rib 6*a*, second spacing rib 6*aa* and first shield rib 7*a*, second shield rib 7*aa* are integrally molded in one molding. Therefore, the number of processing step is reduced, the mass productivity is enhanced, the number of components is few, and the manufacturing cost can be reduced.

When first spacing rib 6*a* and first shield rib 7*a* on the surface in the X-direction of heat transfer plate 4 and second spacing rib 6*aa* and second shield rib 7*aa* on the surface in the Y-direction of the heat transfer plate are insert injection molded, they are integrally formed with heat transfer plate 4 in between. Therefore, unit element 2*a* with high air tightness is formed, and heat exchanger 1*a* capable of preventing leakage of air current is obtained by stacking such unit element 2*a*.

Heat exchanger 1*a* has rib pass-through hole 9 formed at a position of coupling to at least one of first spacing rib 6*a*, second spacing rib 6*aa* and first shield rib 7*a*, second shield rib 7*aa*, so that unit element 2*a* including the above can be integrally formed in one resin molding, and mass productivity can be enhanced.

In heat exchanger 1*a*, since unit element 2*a* is formed into a square, heat exchanger 1*a* can be formed by alternately stacking one unit element 2*a* while rotating 90 degrees, and thus one die merely needs to be arranged and the manufacturing cost can be reduced.

Heat exchanger 1*a* has rib pass-through hole 9 formed at the four corners of unit element 2*a*, so that when unit element 2*a* is incorrectly stacked, a state in which stacking check convex part 11 arranged at the periphery of rib pass-through hole 9 and one part of adjacent unit element 2*a* (second shield rib 7*aa*) interfere can be easily checked from the side surface of heat exchanger 1*a*. The failure in production can be reduced by correcting the stacking error, and the mass productivity can be enhanced.

Since spacing rib injection port 15 is arranged on first spacing rib 6*a*, and shield rib injection port 14*a* is arranged at the position coupling to first shield rib 7*a*, unit element 2*a* can be integrally formed in one resin molding in second step (molding) 23, and mass productivity can be enhanced. Through the use of insert injection molding method, heat transfer plate 4, first spacing rib 6*a*, second spacing rib 6*aa*, and first shield rib 7*a*, second shield rib 7*aa* are integrally molded in one molding, whereby the number of processing step is reduced, the mass productivity can be enhanced, the number of components is few, and the manufacturing cost can be reduced.

Spacing rib injection port 15 and shield rib injection port 14*a* have a lowered step at first spacing rib 6*a* and first shield rib 7*a* as a stacking escape part. Therefore, even in the even burr produces at spacing rib injection port 15 and shield rib injection port 14*a*, adjacent unit elements 2*a* do not interfere by escaping the burr by the stacking escape part when stacking unit elements 2*a*, whereby unit elements 2*a* can be stacked without forming a gap, and the leakage of air current can be prevented.

The lowered step of shield rib injection port 14*a* is coupled to first shield rib 7*a* and is arranged in ventilation path 5, so that the burr is positioned in ventilation path 5, whereby unit elements 2*a* can be stacked without interfering by escaping the burr by the space of ventilation path 5 with the adjacent unit element and without forming a gap, and the leakage of air current can be prevented.

Injection mold 24 for resin molding unit element 2*a* includes a means for realizing runnerless, where spool runner 26, which becomes a waste material in time of resin molding, does not produce, thereby reducing the manufacturing cost by saving the resin material cost, and saving resource.

If the hot runner is used as a means for realizing runnerless, the runner/gate part of injection mold 24 is constantly maintained in a liquid state by heat controlling with heater 25, and thus spool runner 26, which becomes a waste material in time of resin molding, does not produce. Therefore, the manufacturing cost can be reduced by saving the resin material cost, and the resource can be saved. The molding cycle can be shortened since only unit element 2*a* of a molded article can be successively taken out from injection mold 24, and mass productivity can be enhanced.

If the open gate type hot runner is used, the runner/gate part of injection mold 24 is constantly maintained in a liquid state by heat controlling with heater 25, and thus spool runner 26, which becomes a waste material in time of resin molding, does not produce, whereby the manufacturing cost can be reduced by saving the resin material cost, and the resource can be saved. The molding cycle can be shortened since only unit element 2*a* of a molded article can be successively taken out from injection mold 24, and mass productivity can be enhanced.

If the valve gate type hot runner having a gate open/close function is used, burr does not form at spacing rib injection port 15 and shield rib injection port 14*a*. Therefore, adjacent unit elements 2*a* do not interfere by the burr when unit elements 2*a* are stacked, unit elements 2*a* can be stacked without forming a gap, and the leakage of air current can be prevented.

Second Embodiment

Figure 14:
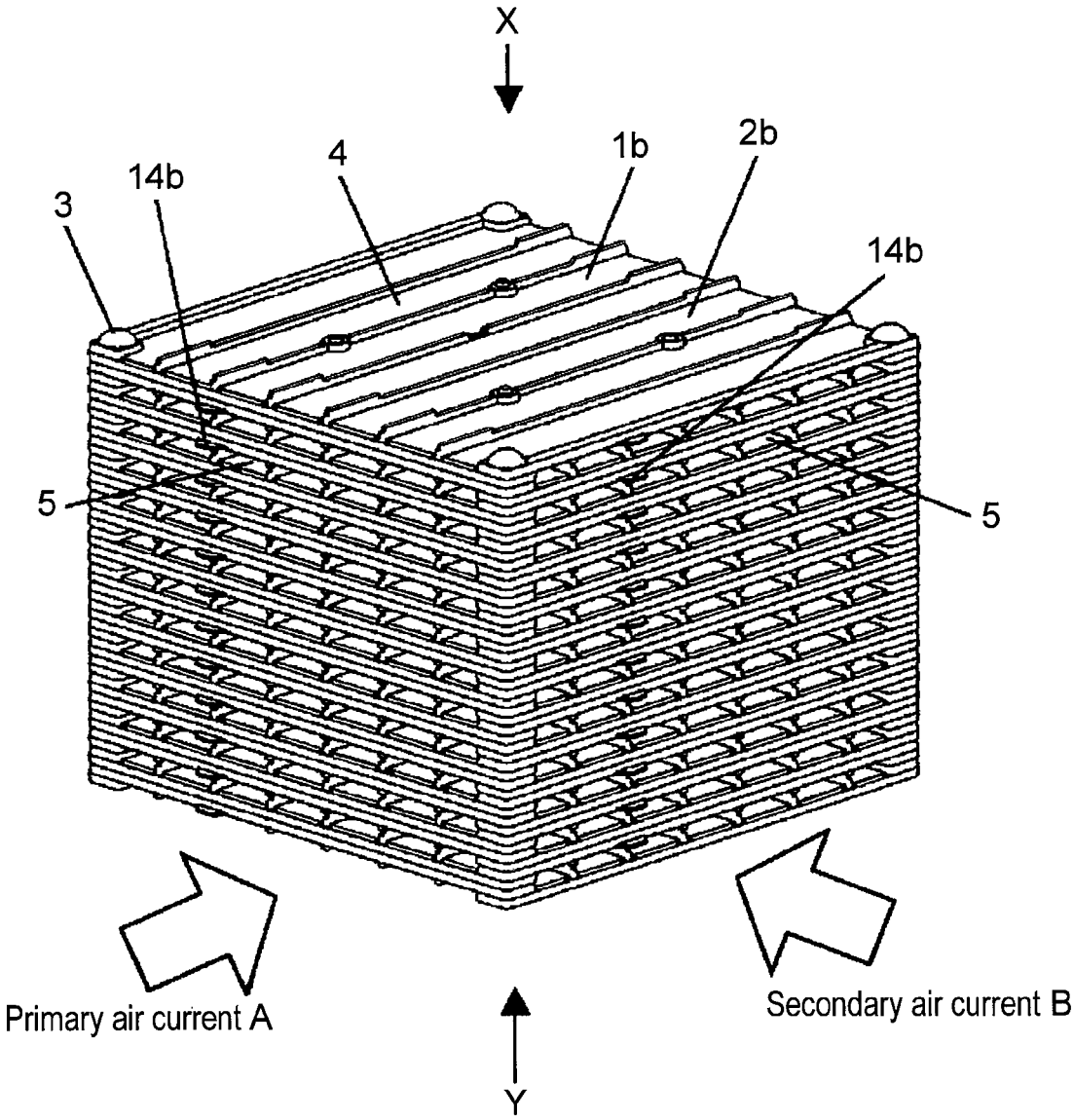
FIG. 14 is a schematic perspective view of a heat exchanger according to the second embodiment of the present invention.
Figure 15A:
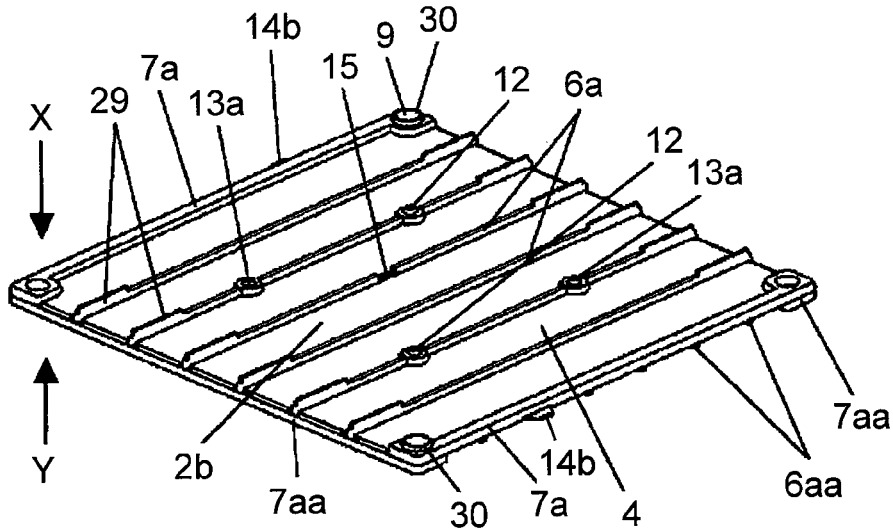
FIG. 15A is a schematic perspective view of a unit element seen from an X-direction shown in FIG. 14.
Figure 15B:
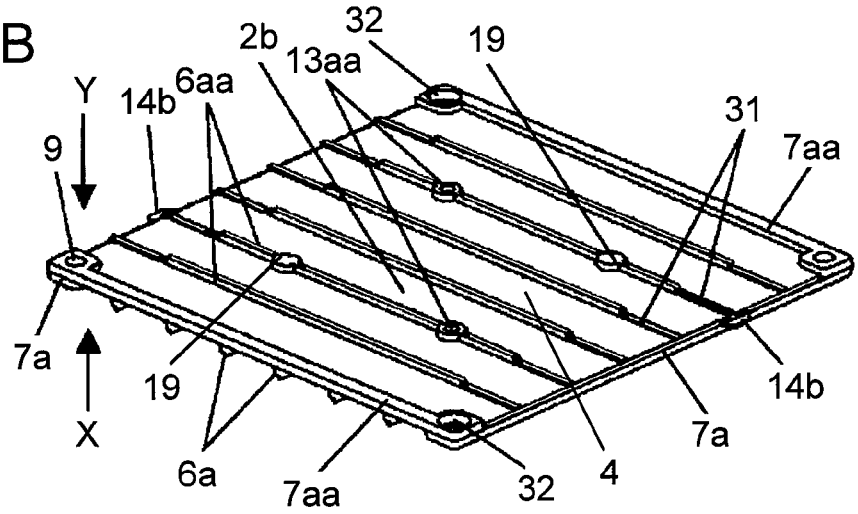
FIG. 15B is a schematic perspective view of the unit element seen from a Y-direction shown in FIG. 14.
Figure 16A:
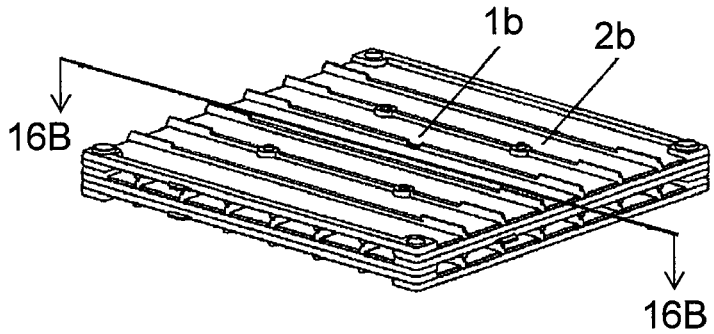
FIG. 16A is a schematic perspective view of the heat exchanger in which the unit elements of the heat exchanger shown in FIG. 14 are correctly stacked.
Figure 16B:
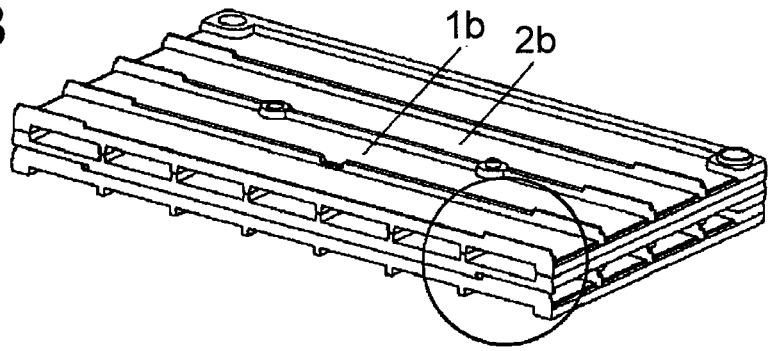
FIG. 16B is a schematic perspective view of the heat exchanger taken along line 16B-16B shown in FIG. 16A.
Figure 16C:
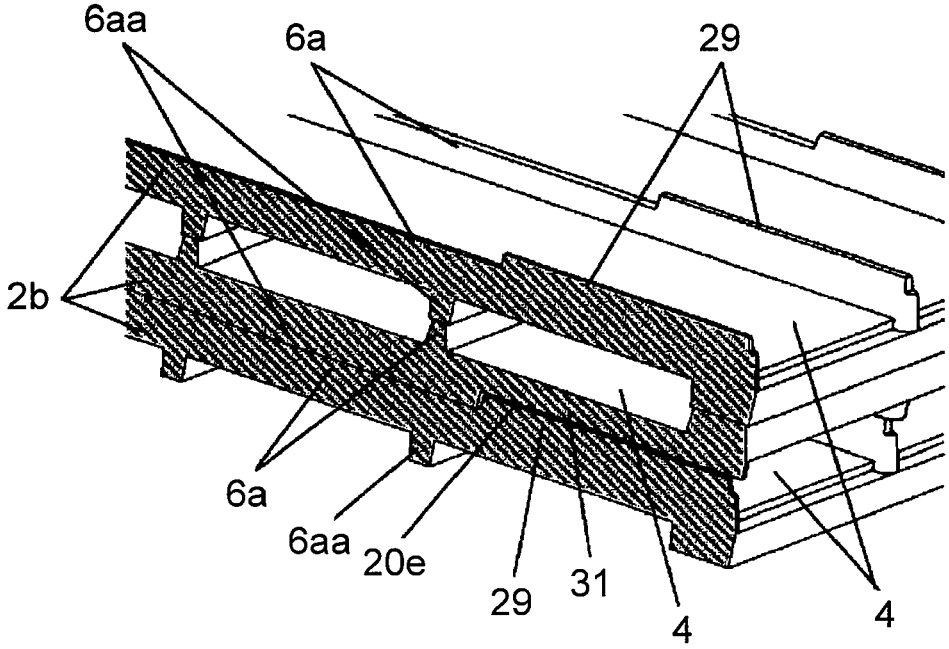
FIG. 16C is a schematic enlarged perspective view of a circled portion in FIG. 16B.

FIG. 14 is a schematic perspective view of a heat exchanger according to the second embodiment, FIG. 15A is a schematic perspective view of a unit element seen from an X-direction shown in FIG. 14, and FIG. 15B is a schematic perspective view of the unit element seen from a Y-direction shown in FIG. 14. FIG. 16A is a schematic perspective view of the heat exchanger in which the unit elements of the heat exchanger shown in FIG. 14 are correctly stacked, FIG. 16B is a schematic perspective view of the heat exchanger taken along line 16B-16B shown in FIG. 16A, and FIG. 16C is a schematic enlarged perspective view of a circled portion in FIG. 16B.

Figure 17A:
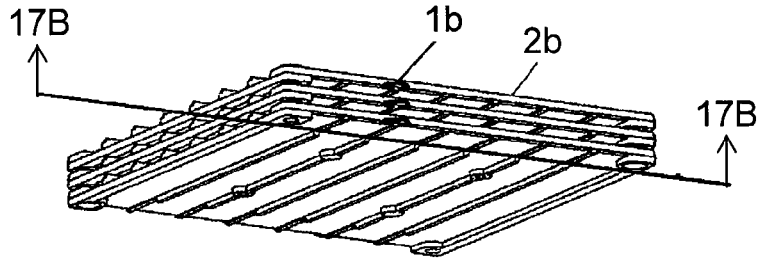
FIG. 17A is a schematic perspective view of the heat exchanger in which the unit elements of the heat exchanger shown in FIG. 14 are incorrectly stacked.
Figure 17B:
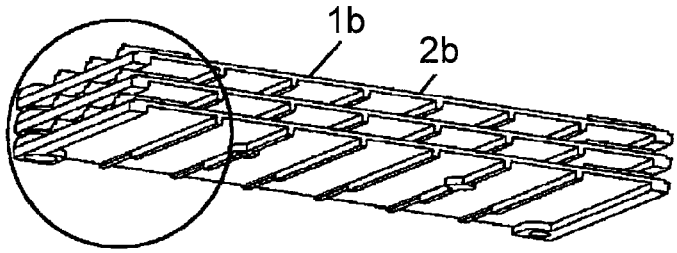
FIG. 17B is a schematic perspective view of the heat exchanger taken along line 17B-17B shown in FIG. 17A.
Figure 17C:
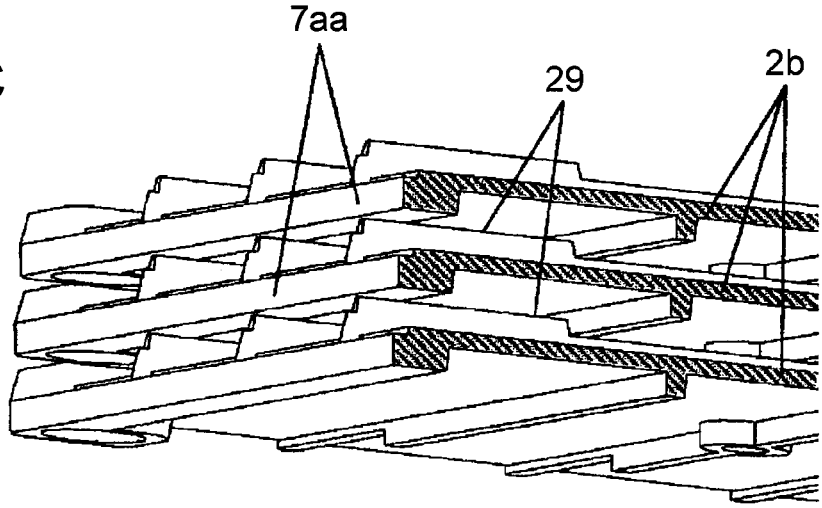
FIG. 17C is a schematic enlarged perspective view of a circled portion in FIG. 17B.
Figure 18A:
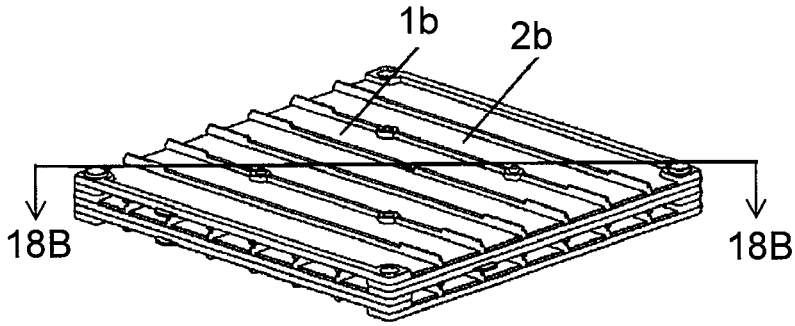
FIG. 18A is a schematic perspective view of the heat exchanger in which the unit elements of the heat exchanger shown in FIG. 14 are correctly stacked.
Figure 18B:
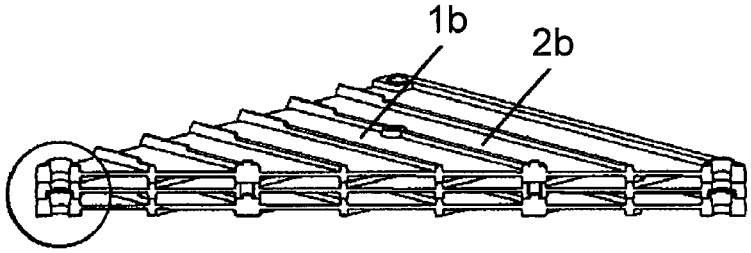
FIG. 18B is a schematic perspective view of the heat exchanger taken along line 18B-18B shown in FIG. 18A.
Figure 18C:
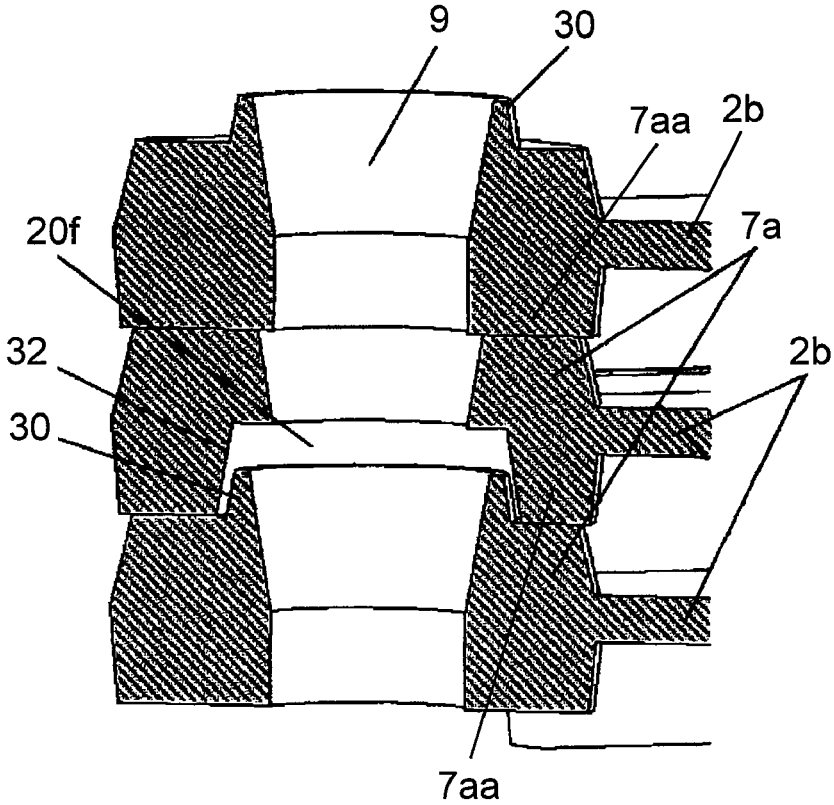
FIG. 18C is a schematic enlarged perspective view of a circled portion in FIG. 18B.

FIG. 17A is a schematic perspective view of the heat exchanger in which the unit elements of the heat exchanger shown in FIG. 14 are incorrectly stacked, FIG. 17B is a schematic perspective view of the heat exchanger taken along line 17B-17B shown in FIG. 17A, and FIG. 17C is a schematic enlarged perspective view of a circled portion in FIG. 17B. FIG. 18A is a schematic perspective view of the heat exchanger in which the unit elements of the heat exchanger shown in FIG. 14 are correctly stacked, FIG. 18B is a schematic perspective view of the heat exchanger taken along line 18B-18B shown in FIG. 18A, and FIG. 18C is a schematic enlarged perspective view of a circled portion in FIG. 18B.

Figure 19A:
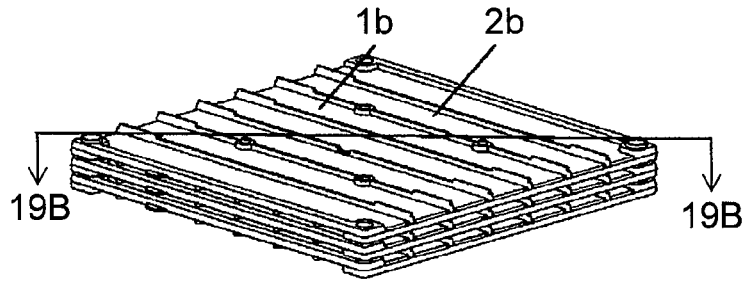
FIG. 19A is a schematic perspective view of the heat exchanger in which the unit elements of the heat exchanger shown in FIG. 14 are incorrectly stacked.
Figure 19B:
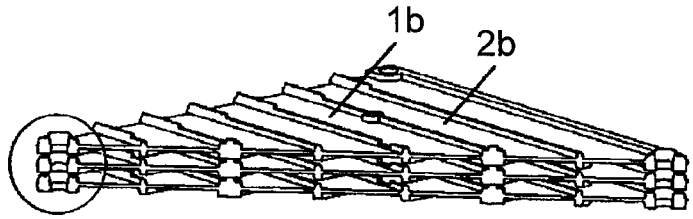
FIG. 19B is a schematic perspective view of the heat exchanger taken along line 19B-19B shown in FIG. 19A.
Figure 19C:
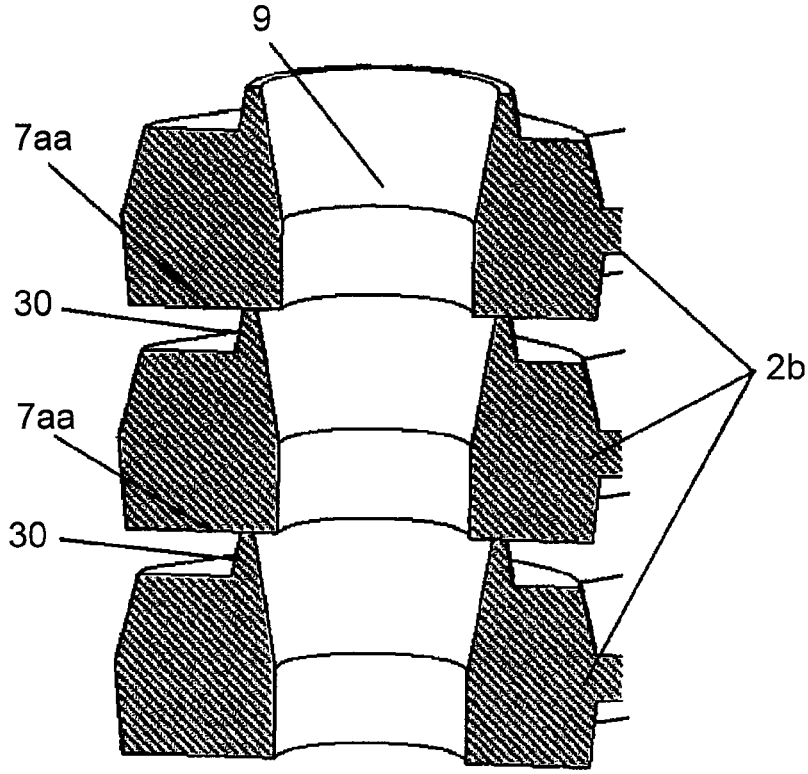
FIG. 19C is a schematic enlarged perspective view of a circled portion in FIG. 19B.
Figure 20A:
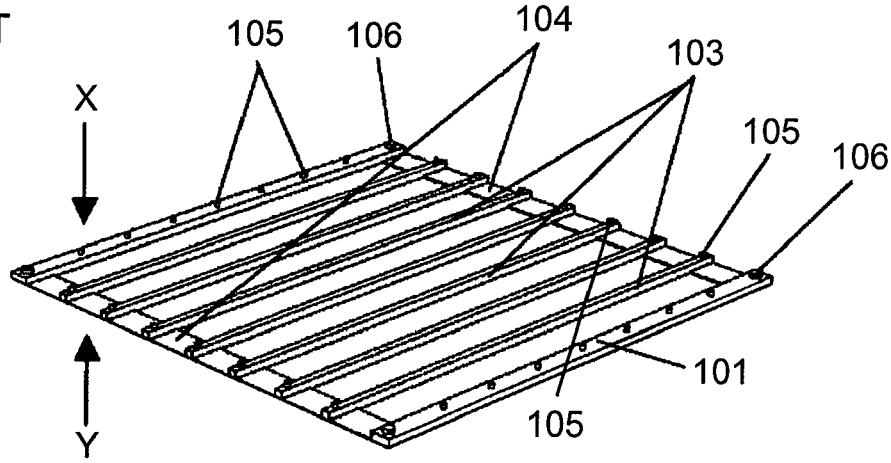
FIG. 20A PRIOR ART
FIG. 20A is a schematic perspective view seen from an X-direction of spacer 101 of conventional heat exchanger 109.
Figure 20B:
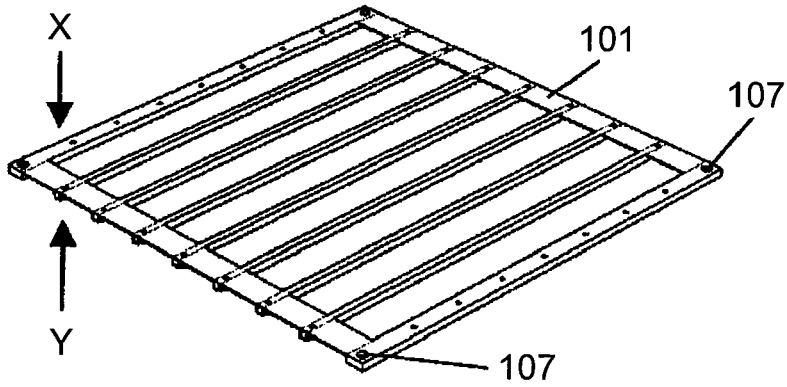
FIG. 20B PRIOR ART
FIG. 20B is a schematic perspective view seen from an Y-direction of spacer 101 of conventional heat exchanger 109.
Figure 21:
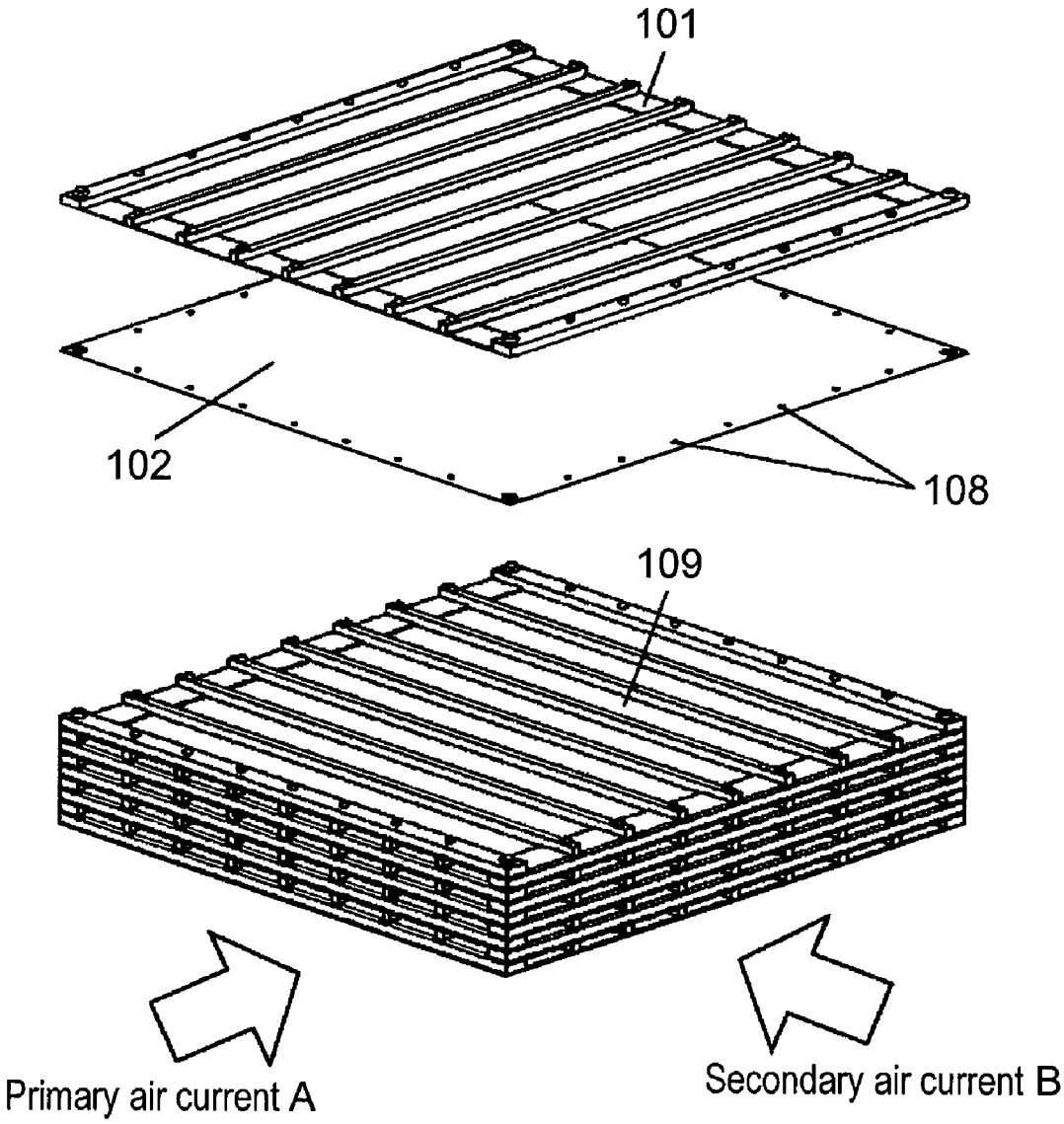
FIG. 21 PRIOR ART
FIG. 21 is a schematic perspective view showing conventional heat exchanger 109.

FIG. 19A is a schematic perspective view of the heat exchanger in which the unit elements of the heat exchanger shown in FIG. 14 are incorrectly stacked, FIG. 19B is a schematic perspective view of the heat exchanger taken along line 19B-19B shown in FIG. 19A, and FIG. 19C is a schematic enlarged perspective view of a circled portion in FIG. 19B.

In the second embodiment, same reference numerals are denoted for the same portions as the first embodiment and are assumed to exhibit the same effects, whereby detailed description will be omitted.

In FIGS. 14, 15A, 15B, 16A, 16B, and 16C, heat exchanger 1*b* is configured by stacking unit element 2*b* of a square having one side of 120 mm and a thickness of 2.0 mm while alternately rotating by 90 degrees, and bonding unit elements 2*b* with supporting rod 3. When primary air current A and secondary air current B are flowed to ventilation path 5 formed between heat transfer plates 4, primary air current A and secondary air current B exchange heat while being orthogonal through heat transfer plate 4.

Unit element 2*b* shown in FIGS. 15A and 15B includes first spacing rib 6*a*, spacing rib convex part 29, first shield rib 7*a*, rib pass-through hole 9, pass-through hole partial convex part 30 as convex part arranged at the periphery of one part of rib pass-through hole 9, positioning convex part 12, positioning pass-through hole 13*a*, shield rib injection port 14*b*, and spacing rib injection port 15 on the surface in the X-direction of heat transfer plate 4. Second spacing rib 6*aa*, spacing rib concave part 31, second shield rib 7*aa*, rib pass-through hole 9, positioning pass-through hole 13*aa*, pass-through hole partial convex part 32 as concave part arranged at the periphery of one part of rib pass-through hole, and positioning plane part 19 are arranged on the surface in the Y-direction of heat transfer plate 4. Unit element 2*b* is obtained by integrally molding with resin so that first spacing rib 6*a*, second spacing rib 6*aa*, and first shield rib 7*a*, second shield rib 7*aa* sandwich heat transfer plate 4 in between.

On the surface in the X direction of heat transfer plate, six first spacing ribs 6*a* are formed at a predetermined interval at a height of 1 mm and a width of 1 mm, and first shield rib 7*a* is formed into a height of 1 mm and a width of 5 mm in parallel to first spacing rib 6*a* at a set of ends facing each other of heat transfer plate 4. Spacing rib convex part 29 is formed into a convex shape to a convex height of 0.4 mm, a width of 1 mm, and a length of 15 mm at both ends in the length direction on the upper surface of first spacing rib 6*a*. Shield rib injection port 14*b* has a trapezoid shape and couples with first shield rib 7*a*, and is formed into the convex height of 0.5 mm from heat transfer plate 4 on the outer side of ventilation path 5.

Rib pass-through hole 9 is at four corners of unit element 2*b*, where a hole is formed at four locations in first shield rib 7*a*. Pass-through hole partial convex part 30 forms a convex shape of a convex height of 0.4 mm at the periphery of the hole of rib pass-through hole 9 at two locations at opposing corners of square unit element 2*b*, as one part of the hole at four locations of rib pass-through hole 9. Two positioning convex parts 12 are arranged at a convex height of 1.7 mm on the upper surface of first spacing rib 6*a*, positioning pass-through hole 13*a* has two cylinders having a convex height of 1.0 mm arranged at first spacing rib 6*a*, and spacing rib injection port 15 is formed into a shape that a step of first spacing rib 6*a* is lowered to a concave height of 0.5 mm on the upper surface of first spacing rib 6*a*.

On the surface in the Y-direction of heat transfer plate 4, six second spacing ribs 6*aa* are formed at a predetermined interval orthogonal to first spacing rib 6*a* at a height of 1 mm and a width of 1 mm, and second shield rib 7*aa* is formed into a height of 1 mm and a width of 5 mm in parallel to second spacing rib 6*aa* at a set of ends facing each other of heat transfer plate 4. Shield rib concave part 31 is formed into a concave shape at a concave height of 0.5 mm, a width of 1 mm, and a length of 15.1 mm at both ends in the length direction on the upper surface of second spacing rib 6*aa*. Rib pass-through hole 9 is at four corners of unit element 2*b*, where a hole is formed at four locations in second shield rib 7*aa*. Pass-through hole partial concave part 32 forms a convex shape of a convex height of 0.5 mm at the periphery of the hole of rib pass-through hole 9 at two locations at opposing corners of square unit element 2*b*, as one part of the hole at four locations of rib pass-through hole 9. Positioning plane part 19 has a circular column having a convex height of 11.0 mm at two locations on the opposite side of positioning convex part 12 with heat transfer plate 4 in between, and positioning pass-through hole 13*aa* has two cylinders arranged at a convex height of 11.0 mm on the opposite site of positioning pass-through hole 13*a* with heat transfer plate 4 in between.

As shown in FIGS. 16A, 16B, and 16C, first spacing rib 6*a* and second spacing rib 6*aa* are formed so that adjacent first spacing rib 6*a* and second spacing rib 6*aa* overlap each other when unit element 2*a* is stacked while alternately rotating by 90 degrees, and have a function of holding heat transfer plate 4 at a constant spacing. In the present embodiment, heat transfer plate 4 is stacked every 2 mm since the convex height of first spacing rib 6*a* and second spacing rib 6*aa* is 1 mm.

As shown in FIGS. 16A, 16B, and 16C, spacing rib convex rib convex part 29 and spacing rib concave part 31 are formed so that the convex part of spacing rib convex part 29 and the concave part of spacing rib concave part 31 adjacent to each other fit when unit elements 2*b* are correctly stacked while being alternately rotated by 90 degrees. In heat exchanger 1*b*, unit elements 2*b* are fixed to each other, and positional shift that occurs when stacking unit element 2*b* is prevented by the fit-in of spacing rib convex part 29 and spacing rib concave part 31 arranged on first spacing rib 6*a* and second spacing rib 6*aa*.

The configuration of holding heat transfer plate 4 of heat exchanger 1*b* at a constant spacing is carried out by overlapping adjacent first spacing rib 6*a* and second spacing rib 6*aa* as shown in FIG. 16C, and the fit-in of the convex part of spacing rib convex part 29 and the concave part of spacing rib concave part 31 also holds heat transfer plate 4 at a constant spacing. In this specification, first spacing rib 6*a* and second spacing rib 6*aa* always made to overlap, and the fit-in of spacing rib convex part 29 and spacing rib convex part 31 is arranged with stacking escape part 20*e* of 0.1 mm in the height direction in view of manufacturing precision of the die and the precision of the resin mold.

Stacking escape part 20*e* is arranged in the height direction of 0.1 mm but heat transfer plate 4 of heat exchanger 1*b* merely needs to be maintained at a constant spacing when unit elements 2*b* are correctly stacked. Accordingly it is appropriately determined according to the design of the heat exchanger and the manufacturing precision.

As shown in FIGS. 17A, 17B, and 17C, if unit elements 2*b* are incorrectly stacked without being alternately rotated by 90 degrees, the convex part of spacing rib convex part 29 interferes with adjacent second shield rib 7*aa*, and adjacent unit elements 2*b* cannot be fitted together. Checking from the side surface of heat exchanger 1*b*, a gap forms between unit elements 2*b*, and thus error stacking of unit elements 2*b* can be easily checked.

Spacing rib convex part 29 and spacing rib concave part 31 are arranged on first spacing rib 6*a* and second spacing rib 6*aa* of unit element 2*b*, but the configuration is not limited thereto. As long as a structure is made in such a way that the concave part and the convex part of the adjacent unit elements fit to each other when the unit elements are correctly stacked, and that the convex part and one part of the adjacent unit element interfere when they are incorrectly stacked, similar effects can be obtained even if heat exchangers of other configurations are used.

As shown in FIGS. 18A, 18B, and 18C, pass-through hole partial concave part 32 and pass-through hole partial convex part 30 are formed so that the concave part of pass-through hole partial concave part 32 and the convex part of pass-through hole partial convex part 30 adjacent to each other fit to each other when unit elements 2*b* are correctly stacked while being alternately rotated by 90 degrees. In heat exchanger 1*b*, unit elements 2*b* are fixed to each other, and positional shift that occurs when stacking unit elements 2*b* is prevented by the fit-in of pass-through hole partial concave part 32 and pass-through hole partial convex part 30 arranged at two locations on opposing corners of square unit element 2*b*.

The shield of the air current at the four corners of heat exchanger 1*b* is performed by overlapping adjacent first shield rib 7*a* and second shield rib 7*aa* as shown in FIG. 18C, and the fit-in of the concave part of pass-through hole partial concave part 32 and the convex part of pass-through partial hole convex part 30 also shield the air current. In this specification, first shield rib 7*a* and second shield rib 7*aa* are always made to overlap each other, and the fit-in of pass-through hole partial concave part 32 and pass-through hole partial convex part 30 is arranged with stacking escape part 20*f* of 0.1 mm in the height direction in such a manner that the air current does not leak in view of the manufacturing precision of the die and the precision of the resin mold. Stacking escape part 20*f* in the height direction of 0.1 mm is arranged, however, it can be adapted as long as shielding of air current at the four corners of heat exchanger 1*b* and the fit-in of unit elements 2*b* are fitted to each other when unit elements 2*b* are correctly stacked. Accordingly it is appropriately determined according to the design of the heat exchanger and the manufacturing precision.

As shown in FIGS. 19A, 19B, and 19C, if unit elements 2*b* are incorrectly stacked without being alternately rotated by 90 degrees, the convex part of pass-through hole partial convex part 30 interferes with adjacent second shield rib 7*aa*, and adjacent unit elements 2*b* cannot be fitted. Checking from the side surface of heat exchanger 1*b*, a gap forms between unit elements 2*b*, and the stacking error of unit elements 2*a* can be easily checked.

Pass-through hole partial concave part 32 and pass-through hole partial convex part 30 are arranged at two locations at opposing corners of square unit element 2*b* as one part of the hole at four locations of rib pass-through hole 9. For instance, if the concave part of pass-through hole partial concave part 32 and the convex part of pass-through hole partial convex part 30 are arranged at four locations of rib pass-through hole 9 the concave part of pass-through hole partial concave part 32 and the convex part of pass-through hole partial convex part 30 of adjacent unit elements 2*b* fit even when unit elements 2*b* are incorrectly stacked, and stacking error of unit elements 2*b* cannot be recognized. Therefore, pass-through hole partial concave part 32 and pass-through hole partial convex part 30 are arranged at one part of the hole at four locations of rib pass-through hole 9.

In this specification, it is arranged at two locations on opposing corners of square unit element 2*b* as one part of the hole at four locations of rib pass-trough hole 9. One part of the hole of rib pass-through hole 9 merely needs to have a structure in which the concave part and the convex part of the adjacent unit elements fit when unit elements are correctly stacked, and the convex part and one part of the adjacent unit element interfere when they are incorrectly stacked, and similar effects can be obtained even by using heat exchangers of other configurations.

Heat exchanger 1*b* includes a stacking escape part so that adjacent unit elements 2*b* do not interfere when unit elements 2*b* are stacked, and has a configuration in which a lowered step of shield rib injection port 14*b* which is coupled to first shield rib 7*a* and is arranged on the outer side of ventilation path 5 is arranged as the stacking escape part.

As shown in FIG. 14, shield rib injection port 14*b* has a lowered step formed on the outer side of ventilation path 5. Even in the event the burr forms at shield rib injection port 14*b* injected with the molten resin from the die, adjacent unit elements 2*b* do not interfere by escaping burr by the lowered step when unit elements 2*b* are stacked. Since the burr is positioned on the outer side of ventilation path 5, the space with adjacent unit element 2*b* can be enlarged, and unit elements 2*b* can be stacked without interfering by escaping the burr and without forming a gap.

The lowered step of shield rib injection port 14*b* is arranged so as to couple to first shield rib 7*a*, but the injection port for injecting the molten resin merely needs to have a configuration of coupling to at least one of first shield rib 7*a*, arranging on the outer side of ventilation path 5, and forming a lowered step so as to escape the burr, and similar effects can be obtained by using other configurations.

According to such configuration, heat exchanger 1*b* includes spacing rib convex part 29 and spacing rib concave part 31 on first spacing rib 6*a* and second spacing rib 6*aa* as a stacking error detecting unit capable of easily determining the stacking error when unit elements 2*b* are stacked. Thus, the convex part of spacing rib convex part 29 and the concave part of spacing rib concave part 31 of adjacent unit elements 2*b* fit to each other when unit elements 2*b* are correctly stacked, and the convex part of spacing rib convex part 29 and one part of adjacent unit element 2*b* (second shield rib 7*aa*) interfere when they are incorrectly stacked.

Therefore, the stacking error of unit element 2*b* can be easily checked, the failure in production can be reduced by correcting the stacking error, and the mass productivity can be enhanced. The lowering in sealing property caused by the stacking error of unit elements 2*b* can be prevented, and the leakage of the air current can be prevented. The convex part of spacing rib convex part 29 and the concave part of spacing rib concave part 31 have the concave part and the convex part fitted to each other when stacking unit elements 2*b*, thereby fixing unit elements 2*b* to each other. Therefore, lowering in sealing property caused by the shift of unit element 2*b* can be prevented, the leakage of the air current can be prevented, and the positional shift that occurs when stacking unit elements 2*b* is prevented by the fit-in structure, whereby the mass productivity can be enhanced.

Heat exchanger 1*b* includes rib pass-through hole 9 in unit element 2*b* as a stacking error detecting unit, and pass-through hole partial concave part 32 and pass-through hole partial convex part 30 at two location of opposing corners of square unit element 2*b* as the periphery of one part of rib-pass through hole 9. Pass-through hole partial concave part 32 and pass-through hole partial convex part 30 of adjacent unit elements 2*b* fit if unit elements 2*b* are correctly stacked, and pass-through hole partial convex part 30 and one part of adjacent unit element 2*b* (second shield rib 7*aa*) interfere when they are incorrectly stacked.

Therefore, the stacking error of unit element 2*b* can be easily checked, the failure in production can be reduced by correcting the stacking error, and the mass productivity can be enhanced. The lowering in sealing property caused by the stacking error of unit elements 2*b* can be prevented, and the leakage of the air current can be prevented. Unit elements 2*b* are fixed to each other by fitting pass-through hole partial concave part 32 and pass-through hole partial convex part 30 when unit elements 2*b* are stacked. Therefore, lowering in sealing property caused by the shift of unit element 2*b* can be prevented, the leakage of the air current can be prevented, and the positional shift that occurs when stacking unit elements 2*b* is prevented by the fit-in structure, whereby the mass productivity can be enhanced.

The lowered step of shield rib injection port 14*b* is coupled to first shield rib 7*a*, and is arranged on the outer side of ventilation path 5. Even in the even burr forms at the injection port of unit element 2*b* injected with the molten resin from injection mold 24, adjacent unit elements 2*b* do not interference by escaping the burr by the lowered step when unit elements 2*b* are stacked. Since the burr is positioned on the outer side of ventilation path 5, the space with adjacent unit element 2*b* can be enlarged, unit elements 2*b* can be stacked without interfering by escaping the burr and without forming a gap, and leakage of air current can be prevented.

INDUSTRIAL APPLICABILITY

The heat exchanger of the present invention is useful as a laminated structure heat exchanger used in a home heat exchange ventilation fan, a total heat exchange ventilator of a building etc.

The invention claimed is:

1. A heat exchanger for exchanging heat through a heat transfer plate by flowing a primary air current and a secondary air current to a ventilation path; the heat exchanger comprising:

a plurality of unit elements, each including a corresponding heat transfer plate and the ventilation path formed between adjacent heat transfer plates by stacking the unit elements in plural, wherein each of the unit elements is configured by integrally molding a spacing rib for holding a spacing of two of adjacent heat transfer plates, and a shield rib for shielding leakage of the air current with resin; and each of the unit elements includes a stacking error detecting unit for determining a stacking error when the plurality of unit elements are stacked, wherein the stacking error detecting unit includes a concave part and a convex part on at least one of the spacing rib and the shield rib, the convex part of a first of the plurality of unit elements is located within the concave part of a second of the plurality of unit elements when the plurality of unit elements are stacked alternately offset, and wherein a bottom of the second of the plurality of unit elements contacts the top of either the spacing rib or the shield rib of the first of the plurality of unit elements and a space is defined between the top of a stacking check convex part of the first of the plurality of unit elements and the bottom of a pass through hole concave part of the second of the plurality of unit elements adjacent to the first of the plurality of unit elements.

2. The heat exchanger according to claim 1, wherein the first of the plurality of unit element is stacked while being rotated by 90 degrees in parallel to a heat transfer surface of the heat transfer plate with respect to the second of the plurality of unit element.

3. The heat exchanger according to claim 1, wherein the spacing rib includes a first spacing rib and a second spacing rib, the shield rib includes a first shield rib and a second shield rib, and each of the unit elements includes the first spacing rib and the first shield rib on one surface of the corresponding heat transfer plate, and the second spacing rib and the second shield rib on another surface thereof.

4. The heat exchanger according to claim 3, wherein the first spacing rib and the second spacing rib are configured orthogonal through the corresponding heat transfer plate.

5. The heat exchanger according to claim 1, wherein the convex part and one part of the first and second of the plurality of unit elements interfere with each other when they are incorrectly stacked.

6. The heat exchanger according to claim 5, wherein the concave part and the convex part are arranged on the shield rib.

7. The heat exchanger according to claim 6, wherein the shield rib includes a first shield rib and a second shield rib;

each of the unit elements includes the first shield rib on one surface of the corresponding heat transfer plate, and the second shield rib on another surface thereof; and the concave part and the convex part are formed in a stepwise manner on the first shield rib and the second shield rib, respectively.

8. The heat exchanger according to claim 5, wherein the concave part and the convex part are arranged on the spacing rib.

9. The heat exchanger according to claim 8, wherein the spacing rib includes a first spacing rib and a second spacing rib;

each of the unit elements includes the first spacing rib on one surface of the corresponding heat transfer plate, and the second spacing rib on another surface thereof; and the first spacing rib includes a spacing rib convex part as the convex part, and the second spacing rib includes a spacing rib concave part as the concave part.

10. The heat exchanger according to claim 8, wherein the concave part and the convex part are arranged on both ends in a length direction of the spacing rib.

11. The heat exchanger according to claim 8, wherein the concave part and the convex part include a stacking escape part in a height direction in fitting.

12. The heat exchanger according to claim 5, wherein a rib pass-through hole is formed in at least one of the spacing rib and the shield rib, the concave part and the concave part being arranged at a periphery of the rib pass-through hole.

13. The heat exchanger according to claim 12, wherein each of the unit elements has a supporting rod inserted to the rib pass-through hole to unite the plurality of unit elements.

14. The heat exchanger according to claim 12, wherein each of the unit elements has a square shape, and the rib pass-through hole is formed at four corners of each of the unit elements.

15. The heat exchanger according to claim 14, wherein the concave part is a pass-through hole partial concave part formed at two opposing corners of each of the plurality of unit elements; and the convex part is a pass-through hole partial convex part formed at two opposing corners of each of the plurality of unit elements.

16. The heat exchanger according to claim 12, wherein the concave part and the convex part include a stacking escape part in a height wise direction.

17. The heat exchanger according to claim 12, wherein the corresponding heat transfer plate includes a heat transfer plate pass-through hole, the heat transfer plate pass-through hole communicating with the rib pass-through hole.

18. The heat exchanger according to claim 1, wherein the spacing rib and the shield rib include a coupling part.

19. The heat exchanger according to claim 18, wherein the coupling part has a resin injection port for injecting molten resin.

20. The heat exchanger according to claim 19, wherein the resin injection port includes an escape part for preventing interference of the plurality of unit elements when the plurality of unit elements are stacked.

21. The heat exchanger according to claim 20, wherein the escape part is a lowered step arranged on at least one of the spacing rib and the shield rib.

22. The heat exchanger according to claim 20, wherein the escape part couples to at least one of the spacing rib and the shield rib, and is arranged inside the ventilation path.

23. The heat exchanger according to claim 20, wherein the escape part couples to the shield rib, and is arranged outside the ventilation path.

24. A manufacturing method of a heat exchanger for exchanging heat through a heat transfer plate by flowing a primary air current and a secondary air current to a ventilation path, the method comprising:

a first step of obtaining the heat transfer plate by cutting a heat transfer plate material to a predetermined shape;

a second step of obtaining each of a plurality of unit elements by integrally molding the heat transfer plate, a spacing rib for holding a spacing of the heat transfer plate, and a shield rib for shielding leakage of the air current with resin;

a third step of sequentially stacking a first of the plurality of unit elements rotated by 90 degrees in parallel to a heat transfer surface of the heat transfer plate with respect to a second of the plurality of unit elements adjacent to the first of the plurality of unit elements; and a fourth step of uniting the stacked plurality of unit elements, wherein each of the unit elements includes a stacking error detecting unit for determining a stacking error when the plurality of unit elements are stacked wherein the stacking error detecting unit includes a concave part and a convex part on at least one of the spacing rib and the shield rib, the convex part of the first of the plurality of unit elements is located within the concave part of the second of the plurality of unit elements when the plurality of unit elements are stacked alternately offset, and wherein a bottom of the second of the plurality of unit elements contacts the top of either the spacing rib or the shield rib of the first of the plurality of unit elements and a space is defined between the top of a stacking check convex part of the first of the plurality of unit elements and the bottom of a pass through hole concave part of the second of the plurality of unit elements.

25. The manufacturing method of the heat exchanger according to claim 24, wherein the stacking error detecting unit includes a concave part and a convex part arranged on at least one of the spacing rib and the shield rib, the concave part and the convex part of the first and second of the plurality of unit elements are fit together when the first and second of the plurality of unit elements are correctly stacked, and the convex part and one part of the plurality of first and second unit elements interfere with each other when they are incorrectly stacked.

26. The manufacturing method of the heat exchanger according to claim 24, wherein a die for integrally molding the heat transfer plate in the second step has a runnerless mechanism.

27. The manufacturing method of the heat exchanger according to claim 26, wherein the runnerless mechanism uses a hot runner.

28. The manufacturing method of the heat exchanger according to claim 27, wherein the hot runner is an open gate runner.

29. The manufacturing method of the heat exchanger according to claim 27, wherein the hot runner is a valve gate runner.

30. The manufacturing method of the heat exchanger according to claim 24, wherein the third step includes a step of inserting a supporting rod to a rib pass-through hole formed at four corners of each of the plurality of unit elements.

31. The manufacturing method of the heat exchanger according to claim 24, wherein the fourth step includes a step of mechanically or thermally uniting both ends of the supporting rod.

* * * * *